US011140498B2

(12) United States Patent
Barrett et al.

(10) Patent No.: US 11,140,498 B2
(45) Date of Patent: Oct. 5, 2021

(54) WAX MANAGEMENT SYSTEM

(71) Applicant: Eargo, Inc., Mountain View, CA (US)

(72) Inventors: Michael Barrett, Campbell, CA (US); Manny Ocano, Santa Cruz, CA (US); Daniel Shen, Palo Alto, CA (US); Iain Butler, Santa Cruz, CA (US); Florent Michel, Annemasse (FR); Raphael Michel, Palo Alto, CA (US); Keith Wong, San Francisco, CA (US)

(73) Assignee: Eargo, Inc., San Jose, CA (US)

( * ) Notice: Subject to any disclaimer, the term of this patent is extended or adjusted under 35 U.S.C. 154(b) by 262 days.

(21) Appl. No.: 16/131,324

(22) Filed: Sep. 14, 2018

(65) Prior Publication Data

US 2019/0116438 A1 Apr. 18, 2019

Related U.S. Application Data

(60) Provisional application No. 62/573,254, filed on Oct. 17, 2017.

(51) Int. Cl.
*H04R 25/00* (2006.01)
*H04R 1/10* (2006.01)

(52) U.S. Cl.
CPC ..... *H04R 25/654* (2013.01); *H04R 1/1016* (2013.01); *H04R 25/652* (2013.01); *H04R 25/658* (2013.01); *H04R 25/656* (2013.01); *H04R 2225/023* (2013.01); *H04R 2225/025* (2013.01); *H04R 2460/17* (2013.01)

(58) Field of Classification Search
CPC .... H04R 1/1016; H04R 25/65; H04R 25/652; H04R 25/654; H04R 25/656; H04R 25/658; H04R 2225/025; H04R 2460/17
See application file for complete search history.

(56) References Cited

U.S. PATENT DOCUMENTS

| | | | | |
|---|---|---|---|---|
| 4,972,488 | A | 11/1990 | Weiss et al. | |
| 4,984,277 | A | 1/1991 | Bisgaard et al. | |
| 5,327,500 | A | 7/1994 | Campbell | |
| 5,606,621 | A | 2/1997 | Reiter et al. | |
| 5,654,530 | A | 8/1997 | Sauer et al. | |
| 5,682,020 | A | 10/1997 | Oliveira | |
| 5,864,628 | A * | 1/1999 | Posen | H04R 25/654 381/322 |
| 5,920,636 | A | 7/1999 | Oliveira et al. | |
| 6,009,183 | A | 12/1999 | Taenzer et al. | |
| 6,048,305 | A | 4/2000 | Bauman et al. | |
| 6,097,823 | A | 8/2000 | Kuo | |

(Continued)

FOREIGN PATENT DOCUMENTS

WO WO9709864 3/1997

*Primary Examiner* — Huyen D Le
(74) *Attorney, Agent, or Firm* — Law Office of Alan W. Cannon

(57) ABSTRACT

A guard for a space access device is configured to output air flow through a distal end portion thereof. The guard includes q housing having a proximal end opening, a distal end opening, and a filter portion positioned between the proximal and distal end openings. The filter includes a first plate having a first opening therethrough and a second plate having a second opening therethrough. When the first plate is overlaid in contact with the second plate, this forms an aperture that extends through both the first and second plates.

38 Claims, 16 Drawing Sheets

(56) References Cited

U.S. PATENT DOCUMENTS

| | | | | |
|---|---|---|---|---|
| 6,129,174 | A | 10/2000 | Brown et al. | |
| 6,135,235 | A | 10/2000 | Brimhall | |
| 6,349,790 | B1 | 2/2002 | Brimhall | |
| 6,738,488 | B1 | 5/2004 | Baker | |
| 7,013,016 | B2 | 3/2006 | Wolf | |
| 7,016,512 | B1 | 3/2006 | Feeley et al. | |
| 7,027,608 | B2 | 4/2006 | Fretz et al. | |
| 7,076,076 | B2 | 7/2006 | Bauman | |
| 7,421,086 | B2 | 9/2008 | Bauman et al. | |
| 7,471,800 | B2 | 12/2008 | Neilson | |
| 7,551,747 | B2 | 6/2009 | Huynh et al. | |
| 7,792,315 | B2 | 9/2010 | Mullenborn et al. | |
| 7,940,946 | B2 | 5/2011 | Caldarola | |
| 8,019,106 | B2 | 9/2011 | Gunnersen et al. | |
| 8,284,973 | B2 | 10/2012 | Gabathuler et al. | |
| 8,295,522 | B2 | 10/2012 | Vestergaard et al. | |
| 8,477,978 | B2 | 7/2013 | Caldarola | |
| 8,842,864 | B2 | 9/2014 | Rasmussen et al. | |
| 8,885,859 | B2 * | 11/2014 | van Halteren | H04R 25/654 381/325 |
| 9,456,287 | B2 | 9/2016 | Lindebjerg et al. | |
| 9,648,429 | B2 | 5/2017 | Higgins et al. | |
| 9,980,067 | B2 * | 5/2018 | Dorn | H04R 25/654 |
| 2002/0085728 | A1 | 7/2002 | Shennib et al. | |
| 2004/0258263 | A1 | 12/2004 | Saxton et al. | |
| 2005/0232453 | A1 | 10/2005 | Fideler | |
| 2005/0238192 | A1 | 10/2005 | Ford et al. | |
| 2005/0244026 | A1 | 11/2005 | Nielson | |
| 2006/0067551 | A1 | 3/2006 | Cartwright et al. | |
| 2011/0299712 | A1 | 12/2011 | Bondo et al. | |
| 2014/0334651 | A1 | 11/2014 | Higgins et al. | |
| 2016/0066110 | A1 | 3/2016 | Shennib et al. | |
| 2016/0165334 | A1 | 6/2016 | Grossman | |
| 2016/0323682 | A1 | 11/2016 | Michel et al. | |
| 2017/0311098 | A1 | 10/2017 | Higgins et al. | |

* cited by examiner

WAX MANAGEMENT SYSTEM

CROSS-REFERENCE

This application claims the benefit of U.S. Provisional Application No. 62/573,254, filed Oct. 17, 2017, which application is hereby incorporated herein, in its entirety, by reference thereto.

FIELD OF THE INVENTION

The present invention relates to ear wax barriers and other structures designed to manage the flow of ear wax to address problems associated with hearing aids, in the ear headphones and the like.

BACKGROUND OF THE INVENTION

The ear naturally secretes a substance referred to as cerumen, or more commonly referred to as "ear wax". The ear wax secreted serves a purpose of cleaning an protecting the ear canal and ear structures distal thereto, as it naturally flows in a direction toward the outer ear (Pinna). When an object such as a hearing aid or headphone bone is inserted into the canal of the ear, this presents an obstruction to the natural flow of the ear wax in the ear canal. Because such an object typically includes openings or passageways necessary to permit sound to travel therethrough, these openings or passageways can become partially or completely blocked or filled with ear wax as the ear wax travels toward the outer ear. The accumulation of ear wax in the openings or passageways can lead to degradation of the sound being transmitted from object to the middle and inner ear. Further difficulties may arise in cases where the ear wax travels through the passageways or openings to an extent where it reaches inner working components of the object, where the ear wax can do further damage, up to, and including, rendering the object nonfunctional.

In the case of hearing aids, the receiver, which produces the sound that is directed to the tympanic membrane, can be susceptible to progressive, gradual clogging by ear wax, resulting in progressive, gradual reduction in acoustic gain and power of the acoustic signals that are received at the tympanic membrane. When such degradation becomes severe enough, it can damage the receiver, which then requires an expensive repair or replacement of the hearing aid. In less severe cases, the hearing aid can be serviced to clean away the ear wax accumulation, but this may require the user going to or sending the hearing aid to a service center, which can be time consuming, expensive and inconvenient.

Previous attempts at preventing or controlling ear wax buildup in the receiver of a hearing aid have included the provision of a fine mesh screen in the audio pathway between the receiver and the outside of the hearing aid. Even in instances where the mesh is very fine, such as where openings of the mesh are on the order of 50 to 60 micrometers diameter, ear wax was not prevented from traveling through these openings, due to the capillary action of the surfaces of the through holes (openings) on the ear wax.

U.S. Pat. No. 4,972,488 to Weiss et al. recognizes the problem of coarse meshes being incapable of effectively preventing ear wax from migrating across a coarse mesh screen barrier to the receiver. Weiss et al. further describes that if a barrier is made with a screen size sufficiently small to protect the receive from wax migration, the screen holes will eventually be clogged by the wax. To address these problems, Weiss et al. provides projections that define a tortuous pathway for wax to travel. As a second line of defense, Weiss et al. may provide a screen that may act as a wax catheter for wax particles that may pass through the tortuous pathway barrier. In one embodiment, a screen may positioned in series with an additional screen. The screens can be rotated relative to one another to provide a variable opening between the receiver and the outside of the hearing aid. However the openings defined by the rotated screens have dimensions at least as large, typically larger than the diameter of the wires that define them, which places the openings very close together relative to each other. As a result wax flow into one of the openings will build up and flow into adjacent openings, as it overflows the wire perimeters.

SUMMARY OF THE INVENTION

According to one aspect of the present invention, a guard is provided for a space access device that is configured to output air flow through a distal end portion thereof. The guard includes: a housing having a proximal end opening and a distal end opening, wherein the proximal end opening is configured to be placed nearer than the distal end opening to the output of air flow from the distal end portion of the space access device. A filter portion is positioned in the housing between the proximal and distal end openings. The filter portion includes a first plate having a first opening therethrough, and a second plate having a second opening therethrough. The first plate is overlaid in contact with the second plate to form an aperture that extends through both the first and second plates. The first opening has a first cross-sectional area, the second opening has a second cross-sectional area and the aperture has a third cross-sectional area. The first cross-sectional area is greater than the third cross-sectional area and the second cross-sectional area is greater than the third cross-sectional area.

In at least one embodiment, a perimeter of the aperture is formed by a first perimeter portion formed by a portion of a perimeter of the first opening and a second perimeter portion formed by a portion of a perimeter of the second opening.

In at least one embodiment, the perimeter of the aperture is completely formed by the first and second perimeter portions, and each of the first and second perimeter portions are continuous portions.

In at least one embodiment, the first plate comprises a plurality of the first openings, the second plate comprises a plurality of the second openings, and a plurality of the apertures are formed by the first plate being overlaid in contact with the second plate.

In at least one embodiment, the plurality of first openings are provided in a plurality of rows and a plurality of columns In at least one embodiment, the plurality of first openings and the plurality of second openings are provided in waffle patterns in the first and second plates respectively, and the first openings are offset from the second openings upon overlaying the first plate on the second plate.

In at least one embodiment, the plates are on adjacent, parallel, but different planes, so that the aperture is not formed by a tubular or other enclosed structure on any one plane parallel or coplanar with the parallel planes of the plates.

In at least one embodiment, a smallest cross-sectional dimension of the first opening is at least twice as great as a largest cross-sectional dimension of the aperture and a smallest cross-sectional dimension of the second opening is at least twice as great as the largest cross-sectional dimension of the aperture.

In at least one embodiment, the guard further includes a berm circumscribing the filter portion and extending toward a distal end of the guard.

In at least one embodiment, the space access device comprises an in-the-ear hearing aid.

In at least one embodiment, the space access device comprises an earpiece speaker.

In at least one embodiment, the guard is attached to a securing mechanism. The securing mechanism includes: a base comprising a longitudinal axis and an outer surface; and an adjustable securing portion disposed on at least a portion of the base, the adjustable securing portion being configured to contact a surface of an internal space or opening into which the securing mechanism is inserted. The adjustable securing portion is configured for positioning and maintaining the base at a distance from a location along the internal space or opening. At least a portion of the adjustable securing portion is configured to transition from a first state to a securing state when inserted into the internal space or opening, the securing state comprising at least a portion of the adjustable securing portion being constrained to have a smaller cross-sectional diameter relative to a cross-sectional diameter in the first state. The adjustable securing portion comprises a plurality of members configured to contact a wall of the internal space.

In at least one embodiment, the securing mechanism is attached to the space access device.

In at least one embodiment, the securing mechanism further comprises a sound blocking portion disposed on at least a portion of the base, the sound blocking portion being configured to seal circumferentially around the surface of the internal space or opening.

In at least one embodiment, the adjustable securing portion is configured to allow external sound to be transmitted therepast when the securing mechanism is secured in the internal space or opening.

In at least one embodiment, the adjustable securing portion is configured to allow external sound to be transmitted therepast when the securing mechanism is secured in the internal space or opening and the sound blocking portion is configured to prevent external sound to be transmitted therepast when the securing mechanism is secured in the internal space or opening.

In at least one embodiment, the sound blocking portion comprises a dome fixed to a distal end portion of the base.

In at least one embodiment, the sound blocking portion comprises: a second plurality of members, at least some of the members comprising at least one of: bristles, protrusions, ridges, grooves, blades, bubbles, hooks and tubes; and skirting, wherein the skirting is integrated in spaces between at least some of the second plurality of members.

In at least one embodiment, the skirting is integrated with at least two rows of the second plurality of members, and locations along which the portions of the skirting overlap one another in one of the at least two rows are offset from locations along which the portions of the skirting overlap one another in another of the at least two rows.

In another aspect of the present invention, a guard for a space access device configured to output air flow through a distal end portion thereof includes: a housing having a proximal end opening and a distal end opening, wherein the proximal end opening is configured to be placed nearer than the distal end opening to the output of air flow from the distal end portion of the space access device; a filter portion positioned in the housing between the proximal and distal end openings, the filter portion comprising at least one aperture to allow air to pass from the proximal end opening of the housing to the distal end opening; a berm contacting a perimeter of the filter portion and extending toward a distal end of the guard; and a passageway having a first opening end at a location where the berm contacts the perimeter of the filter portion, the passageway extending through the housing, and having a second opening at an end opposite the first opening, the second opening opening into an external wall of the housing at a location distal of the filter portion.

In at least one embodiment, an inside , cross sectional dimension of the passageway is greater than a largest cross-sectional dimension of the aperture.

In at least one embodiment, the berm circumscribes the filter portion and the passageway comprises a plurality of passageways spaced around a circumference of the filter portion.

In at least one embodiment, the filter portion comprises: a first plate having a first opening therethrough; and a second plate having a second opening therethrough; wherein the first plate is overlaid in contact with the second plate to form the at least one aperture; wherein the first opening has a first cross-sectional area, the second opening has a second cross-sectional area and the aperture has a third cross-sectional areas; and wherein the first cross-sectional area is greater than the third cross-sectional area and the second cross-sectional area is greater than the third cross-sectional area.

In another aspect of the present invention, a guard for a space access device configured to output air flow through a distal end portion thereof includes: a housing having a proximal end opening and a distal end opening, wherein the proximal end opening is configured to be placed nearer than the distal end opening to the output of air flow from the distal end portion of the space access device, and wherein the distal end opening is larger than the proximal end opening; a first channel extending proximally from the distal end opening to a junction located intermediate proximal and distal end of the housing; a second channel extending distally from the proximal end opening; a transverse channel interconnecting the first and second channels; and a wax repository formed by a portion of the second channel that extends distally of the second channel In at least one embodiment, the first channel is not aligned with the second channel.

In at least one embodiment, the transverse channel forms an acute angle with the second channel, such that the transverse channel extends in a transverse and proximal direction from the second channel to the first channel In at least one embodiment, the wax repository is closed ended at an end opposite an end where it extends from the second channel.

In at least one embodiment, the first channel has a first cross-sectional area, the second channel has a second cross-sectional area and the transverse channel has a third cross-sectional area; wherein the first cross-sectional area is greater than the second cross-sectional area; and wherein the second cross-sectional area is greater than the third cross-sectional area.

In at least one embodiment, the wax repository has a fourth cross-sectional area, and the fourth cross-sectional area is equal to the second cross-sectional area.

In at least one embodiment, the space access device comprises an in-the-ear hearing aid.

In at least one embodiment, the space access device comprises an earpiece speaker.

In at least one embodiment, the guard is attached to a securing mechanism, the securing mechanism comprising: a base comprising a longitudinal axis and an outer surface; and an adjustable securing portion disposed on at least a portion of the base, the securing mechanism being configured to contact a surface of an internal space or opening into which the securing mechanism is inserted; the adjustable securing portion being configured for positioning and maintaining the base at a distance from a location along the internal space or opening; and wherein a least a portion of the adjustable securing portion is configured to transition from a first state to a securing state when inserted into the internal space or opening, the securing state comprising at least a portion of the adjustable securing portion being constrained to have a smaller cross-sectional diameter relative to a cross-sectional diameter in the first state; and wherein the adjustable securing portion comprises a plurality of members configured to contact a wall of the internal space.

In at least one embodiment, the securing mechanism is attached to the space access device.

In at least one embodiment, the securing mechanism further comprises a sound blocking portion disposed on at least a portion of the base, the sound blocking portion being configured to seal circumferentially around the surface of the internal space or opening.

In at least one embodiment, the adjustable securing portion is configured to allow external sound to be transmitted therepast when the securing mechanism is secured in the internal space or opening.

In at least one embodiment, the adjustable securing portion is configured to allow external sound to be transmitted therepast when the securing mechanism is secured in the internal space or opening and the sound blocking portion is configured to prevent external sound to be transmitted therepast when the securing mechanism is secured in the internal space or opening.

In at least one embodiment, the sound blocking portion comprises a dome fixed to a distal end portion of the base.

In at least one embodiment, the sound blocking portion comprises: a second plurality of members, at least some of the members comprising at least one of: bristles, protrusions, ridges, grooves, blades, bubbles, hooks and tubes; and skirting, wherein the skirting is integrated in spaces between at least some of the second plurality of members.

In at least one embodiment, the skirting is integrated with at least two rows of the second plurality of members, and locations along which the portions of the skirting overlap one another in one of the at least two rows are offset from locations along which the portions of the skirting overlap one another in another of the at least two rows.

These and other advantages and features of the invention will become apparent to those persons skilled in the art upon reading the details of the devices, assemblies and systems as more fully described below.

BRIEF DESCRIPTION OF THE DRAWINGS

In the course of the detailed description to follow, reference will be made to the attached drawings. These drawings show different aspects of the present invention an, where appropriate, reference numerals illustrating like structures, components, materials and/or elements in different figures are labeled similarly. It is understood that various combinations of the structures, components, materials and/or elements, other than those specifically shown, are contemplated and are within the scope of the present invention.

DETAILED DESCRIPTION OF THE INVENTION

Figure 1:
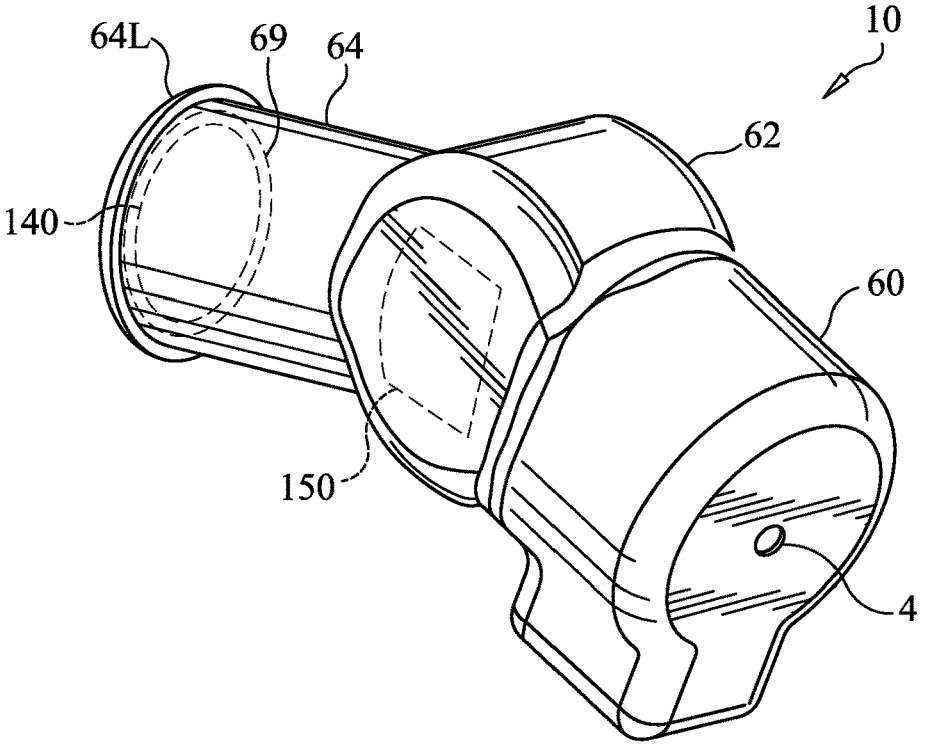
FIG. 1, shows a portion of a space access device in the form of a portion of an in the are hearing aid that can be used as part of a system according to an embodiment of the present invention.

Before the present devices and methods are described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

It must be noted that as used herein and in the appended claims, the singular forms "a", "an", and "the" include plural referents unless the context clearly dictates otherwise. Thus, for example, reference to "a dome" includes a plurality of such domes and reference to "the opening" includes reference to one or more openings and equivalents thereof known to those skilled in the art, and so forth.

The publications discussed herein are provided solely for their disclosure prior to the filing date of the present application. The dates of publication provided may be different from the actual publication dates which may need to be independently confirmed.

Definitions

The term "space access device", as used herein, means a device that is designed and adapted to be inserted into a space or opening, including, but not limited to audio signal transmitting devices, including but not limited to anatomical or biological and non-biological devices that are designed and adapted to be inserted into a space or opening, such as an ear canal, nasal conduit, esophagus, airway, gastrointestinal tract, blood vessel, pipe, or conduit.

The term "outwardly projecting member", as used in connection with a securing mechanism of the invention, means and includes any projection extending from a base member, including, without limitation, fins, bristles, blades, protrusions, ridges, grooves, bubbles, balloons, hooks, looped structure, disks and/or tubes.

The term "overlap" as used herein, refers to two objects or portions thereof existing along a straight line or pathway at different locations of the line or pathway. For example, when one portion of a skirt "overlaps" another portion of a skirt, this overlap blocks a pathway in a direction along a longitudinal axis of a securing mechanism/ hearing device. The overlapping portions served to block sound transmission along the pathway where the portions overlap. In some embodiments, the securing members of different rows of securing members overlap one another. In these examples, a restricted airflow pathway typically remains between the overlapping securing members of different rows. In the case of overlapping skirts, the overlapped portions contact one another and do not allow airflow through the contacted, overlapped portions.

The terms "headphone" and "headset" are used interchangeably herein and mean and include a listening device that is adapted to receive transmitted sound via wireless or wired communication means. As is well known in the art, conventional headphones and headsets typically include one or more speakers and/or sound production components, which can be in the form of one or two earpieces (often referred to as "ear plugs" or "ear buds").

The terms "pharmacological agent", "active agent", "drug" and "active agent formulation" are used interchangeably herein, an mean and include an agent, drug, compound, composition of matter or mixture thereof, including its formulation, which provides some therapeutic, often beneficial, effect. This includes any physiologically or pharmacologically active substance that produces a localized or systemic effect or effects in animals, including warm blooded mammals, humans and primates, avians, domestic household or farm animals, such as cats, dogs, sheep, goats, cattle, horses and pigs; laboratory animals, such as mice, rats and guinea pigs; reptiles, zoo and wild animals, and the like. One or more of the components described herein may be coated with or otherwise provided with one or more pharmacological agents.

The terms "pharmacological agent", "active agent", "drug" and "active agent formulation" thus mean and include, without limitation, antibiotics, anti-viral agents, analgesics, steroidal anti-inflammatories, non-steroidal anti-inflammatories, anti-neoplastics, anti-spasmodics, modulators of cell-extracellular matrix interactions, proteins, hormones, enzymes and enzyme inhibitors, anticoagulants and/or antithrombotic agents, DNA, RNA, modified DNA and RNA, NSAIDs, inhibitors of DNA, RNA or protein synthesis, polypeptides, oligonucleotides, polynucleotides, nucleoproteins, compounds modulating cell migration, compounds modulating proliferation and growth of tissue, and vasodilating agents.

The following disclosure is provided to further explain in an enabling fashion the best modes of performing one or more embodiments of the present invention. The disclosure is further offered to enhance an understanding of and appreciation for the inventive principles and advantages thereof, rather than to limit in any manner the invention. The invention is defined solely by the appended claims including any amendments made during the pendency of this application and all equivalents of those claims as issued.

As will readily be appreciated by one having ordinary skill in the art, the present invention substantially reduces or eliminates the disadvantages and drawbacks associated with conventional wax management systems for in the ear devices.

In overview, one aspect of the present invention is directed to wax management devices that can be readily employed with devices and systems that are configured to be inserted in one or more biological spaces or openings, such as an ear canal.

Referring now to the drawings, FIG. 1 shows a portion of a space access device 10 in the form of a portion of an in the are hearing aid that can be used as part of a system according to an embodiment of the present invention. Space access device 10 in FIG. 1 includes a housing 60 which may house electronic components which may include, without limitation, a microphone, a battery, a sound processor, and/or an actuator. The battery or any other energy storage system may provide power to the other electronic components. The microphone may receive and/or collect sound. The sound processor may be used for sound amplification. The actuator may be used for sound transmission to a passive amplifier.

In the embodiment shown in FIG. 1, a receiver 140, sound processor 150 and speaker 4 are schematically shown. Thus, the distal end portion 64 of the housing 60 houses the receiver 140, the central portion of the housing 60 houses the sound processor 150 and the speaker 4 opens through the proximal end of the housing 60 in the embodiment of FIG. 1. In the embodiment of FIG. 1, body 6 includes a cylindrically-shaped body portion 64 that is configured and dimensioned to receive a securing mechanism slidably thereover. This body portion is not limited to having a cylindrical shape, as it could alternatively have an oval, elliptical, polygonal, or irregular cross-sectional shape, for example, in which cases the securing mechanism would have a mating shape to allow the relative sliding thereover.

Figure 2:
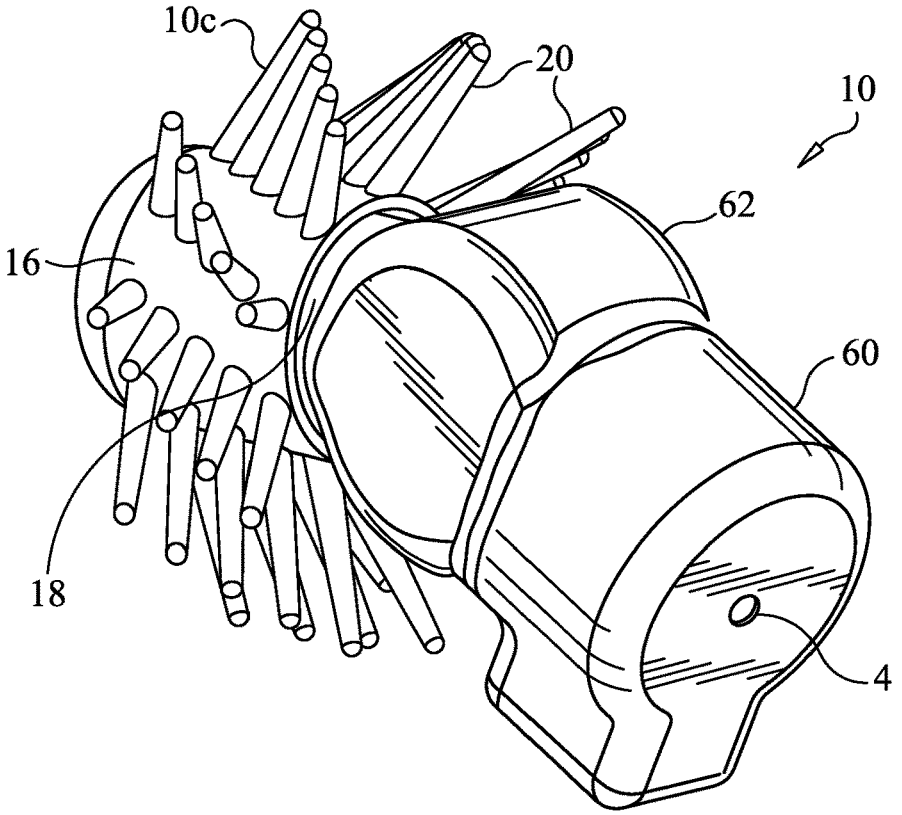
FIG. 2 illustrates a securing mechanism having been mounted on the space access device of FIG. 1, according to an embodiment of the present invention.

FIG. 2 illustrates a securing mechanism 10*c* having been mounted on the space access device 10 of FIG. 1. A lip 64L is provided on an end portion of the body portion 64 that has an outside diameter, in an un-deformed state, that is greater than an inside diameter of the lumen 18 of securing mechanism 10*c* in an un-deformed state. In a preferred embodiment, lip 64L is made of a resiliently compressible material (such as silicone or other elastomer) that allows it to be compressed to a smaller outside diameter as the securing mechanism 10*c* is slid thereover.

Securing mechanism 10*c* (FIG. 2), 10*d* (FIG. 3), 10*e* (FIG. 4) or 10*f* (FIGS. 5A-5C) may secure a space access device that may include an audio signal transmitting device and/or any of the types of space access devices previously mentioned and/or mentioned below. Securing mechanism 10*c*, 10*d*, 10*e*, 10*f* may include adjustable securing members 20 (FIG. 2), 40 (FIG. 3), 120 (FIG. 4), 130 (FIGS. 5A-5C) that form an adjustable securing portion and which may be outwardly projecting members that include, but are not limited to, one or more of fins, bristles, blades, protrusions, ridges, grooves, bubbles, balloons, hooks, looped structure, disks, and/or tubes.

The adjustable securing mechanism 10*c*, 10*d*, 10*e*, 10*f* is disposed on at least a portion of the base 16 and is configured to contact a surface of an internal space or opening into which said securing mechanism 10*c*, 10*d*, 10*e*, 10*f* is inserted.

The securing portion, by action of the adjustable, outwardly projecting members 20, 40, 120, 130 is configured for positioning and maintaining the base 16 (and a space access device when the securing mechanism is mounted thereon) at a distance from a location along the internal space or opening. Thus, for example, when the securing mechanism is mounted on or attached to an in-ear hearing aid, the adjustable, outwardly projecting members adjust so as to keep the base 16 and the space access securing device located in the internal space or opening so that a distance or gap is provided between the base 16 and the space access device at all locations 360 degrees about the base and space access device.

The securing portion is configured for positioning and maintaining the base and the space access device at a distance from a location such as an end of the internal space or opening. For example, the adjustable securing portion of the securing mechanism 10*c*, 10*d*, 10*e*, 10*f* may be configured to maintain a distal end of a hearing aid and distal end of the securing mechanism at a predetermined distance relative to the ear drum. As another example, the securing portion of the mechanism 10*c*, 10*d*, 10*e*, 10*f* may be configured to maintain a proximal end of a hearing aid at a predetermined distance relative to the opening of the ear canal. The securing portion 10*c*, 10*d*, 10*e*, 10*f* is designed and adapted to conform or self-adjust to the shape of the interior surface of an opening (or interior space) of a member (biological or non-biological) when the securing mechanism (typically, but not necessarily attached to an access device) of the invention and, thereby, the projecting members 20, 40, 120, 130 are inserted in the opening by a tube, such as a tube defining an internal anatomical space. Further details regarding the securing mechanisms 10*c*, 10*d*, 10*e*, 10*f* can be found in co-pending U.S. Application Serial No. 15/785,731, filed on even date herewith, titled "Adjustable Securing Mechanism" and which is hereby incorporated herein, in its entirety, by reference thereto.

Figure 3:
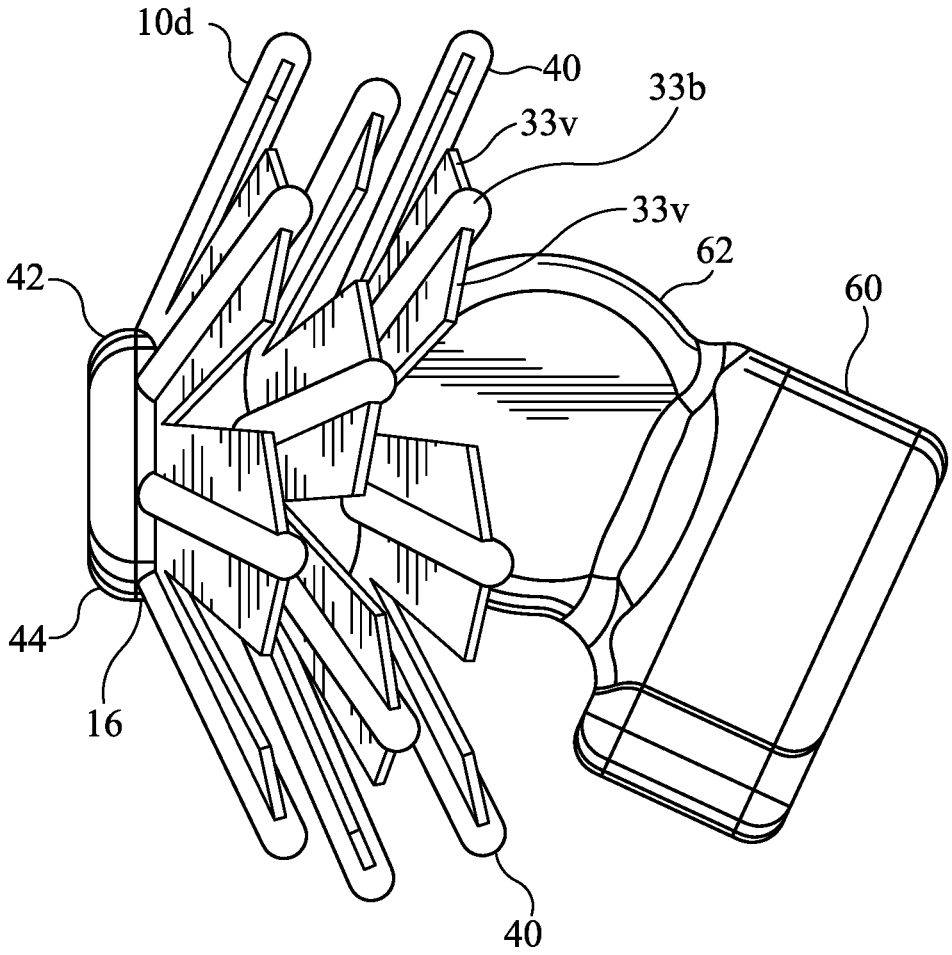
FIG. 3 illustrates a securing mechanism having been mounted on the space access device of FIG. 1, according to another embodiment of the present invention.

In FIG. 3 the distal end component 44 may interface with the lip 64L to prevent inadvertent removal of the securing mechanism 10*d* from a space access device once it has been secured in place. Bristles 40 include sound reducing vanes 33V that are provided on bristle cores 33B. The bristle cores 33B may be substantially cylindrical (although other cross-sectional shapes may be employed, as noted above) and provide added structural support to the bristle member 40. However, the bristle cores 33B are not strictly necessary, and the bristles may be constructed from a pair of vanes angled with respect to one another like shown, or even as single vanes.

Figure 4:
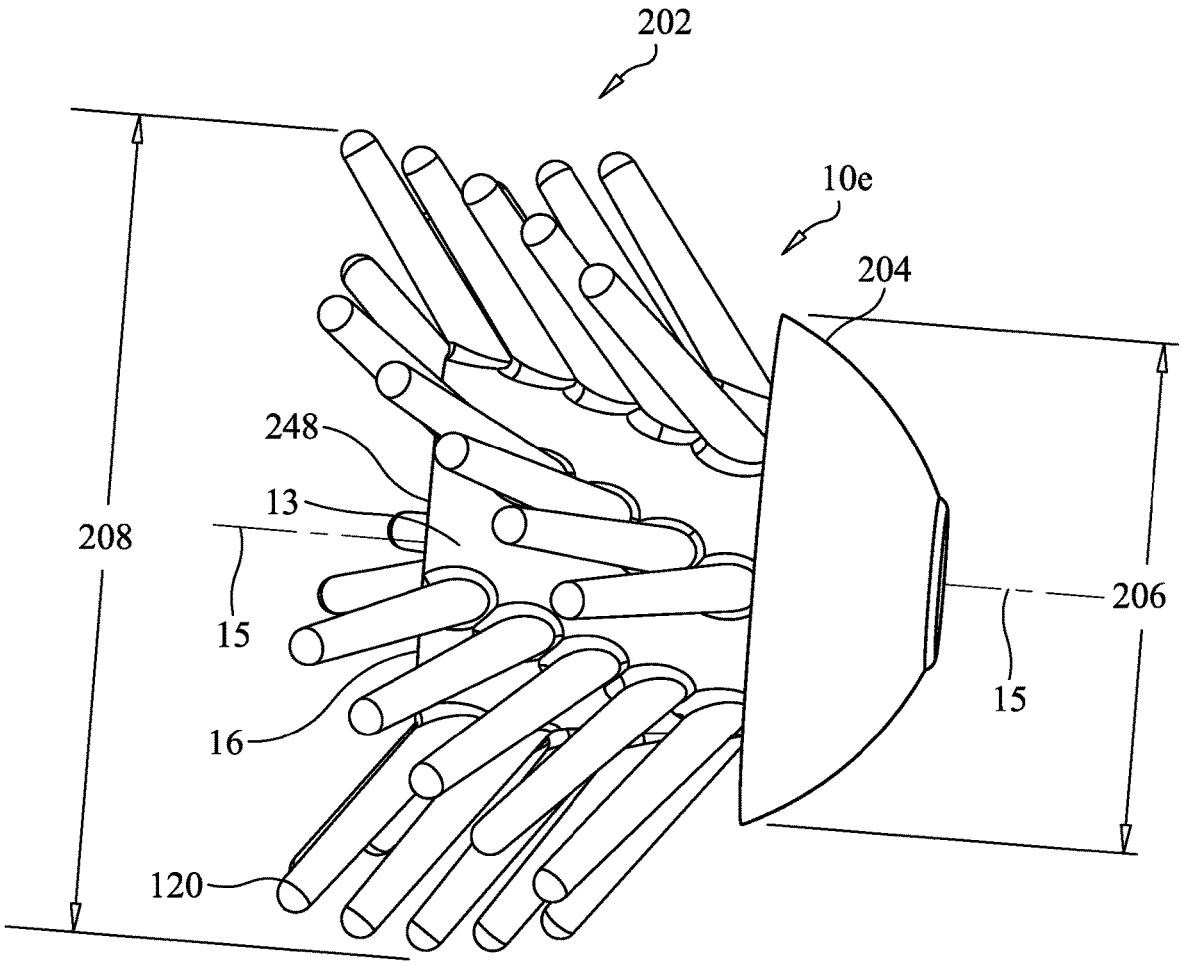
FIG. 4 illustrates a securing mechanism that can be used as part of a system according to an embodiment of the present invention.

FIG. 4 shows a side view of a securing mechanism l0*e* that includes a securing portion 202 and a sound blocking portion 204, according to an embodiment of the present invention. Although the outwardly projecting members 120 used in FIG. 4 are of the type and arrangement of outwardly projecting members 20 shown in FIG. 2, it is noted that any of the other alternative embodiments of outwardly projecting members as described herein could be substituted in whole or in part, while maintaining air channels 13 to allow air flow between the walls of an inner space or opening and the securing portion 202 to provide benefits, such as being substantially more comfortable and allowing for longer wear time, maintaining air circulation within the ear canal, and/or minimizing the potential for development of hot spots that often occur in devices that block the ear canal. Although the embodiment of FIG. 4 is described for use with a hearing aid device, it is noted that the securing mechanism embodiment of FIG. 4, like all other embodiment of securing mechanisms described herein, can alternatively be used with headset speakers or other space access devices as described herein.

In the embodiment of FIG. 4, sound blocking portion 204 may be attached to or integral with a distal end portion of the securing mechanism 10*e*. The securing mechanism l0*e* includes a lumen 248 that is configured to slide over a mating portion of a space access device in any of the same manners described above with regard to lumen 18, with the securing portion 202 being slid over the space access device portion so that the sound blocking portion 204 is distal thereof.

Blocking portion 204 may be made of the same material as outwardly projecting members 120 and/or the main body of the securing mechanism, or may be made from a different material selected from any of the materials described previously in this disclosure, including, but not limited to thermoplastic elastomers. Preferably the blocking portion 204, projecting members 120 and main body are all molded from the same material, preferably silicone. The hardnesses of the components may be the same or different and may each be in the range from about 20 durometer Shore A to about 80 durometer Shore A, preferably from about 30 to 60 durometer Shore A. In one example, the components were molded from platinum-cured silicone have a hardness of 60 durometer Shore A. In another example, the components were molded from platinum-cured silicone having a hardness of 40 durometer Shore A. Because the securing portion 202 provides the primary anchoring forces for holding the securing mechanism 10*e* in place in an inner space or opening, the outside diameter 206 (for a sound blocking portion 204 having a circular cross-section) or largest cross-sectional dimension 206 of the sound blocking portion 204, in a direction normal to the longitudinal axis 15 of the securing mechanism 10*e*, when in a relaxed configuration as shown in FIG. 4, can be significantly less than an outside diameter, or largest cross-sectional dimension 208, in a direction normal to the longitudinal axis 15, of the securing portion 202/outwardly projecting members 120 when in the relaxed configuration. For example, the largest cross-sectional dimension 206 (outside diameter in this case, since the cross-section of this embodiment is circular) of sound blocking portion 204 in a direction normal to axis 15 in the embodiment of FIG. 4 may be in the range from about 6 mm to about 11 mm, preferably in a range from about 7 mm to about 11 mm, more preferably from about 8 mm to about 10 mm. The largest cross-sectional dimension 208 of securing portion 202/outwardly projecting members 120 may be in the range from about 10 mm to about 17 mm, preferably in a range from about 11 mm to about 16 mm. In one example, dimension 206 was about 8 mm and dimension 208 was about 12 mm. In another example, dimension 206 was about 8 mm and dimension 208 was about 15 mm. In another example, dimension 206 was about 10 mm and dimension 208 was about 15 mm. The blocking portion 204 in FIG. 4 comprises a dome or other continuous member that seals with the opening or internal space, such as a disk, saucer or the like. The sound blocking portion 204 may be made of the same materials as that of the securing portion 202 or of the outwardly extending members 120 or may be made from one or more different materials. Further, the blocking portion may have the same or different hardness relative to the securing portion 202 or outwardly projecting members 120, whether or not made of the same material.

Figure 5B:
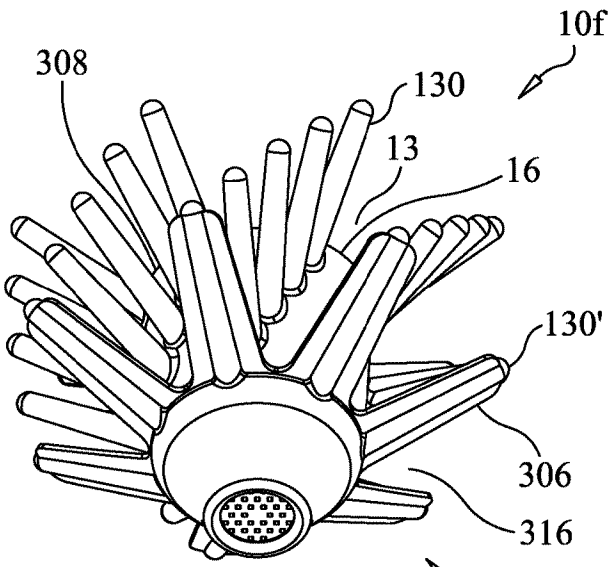
FIGS. 5A-5C illustrate variants of securing mechanism that can each be used as part of a system according to an embodiment of the present invention.
Figure 5A:
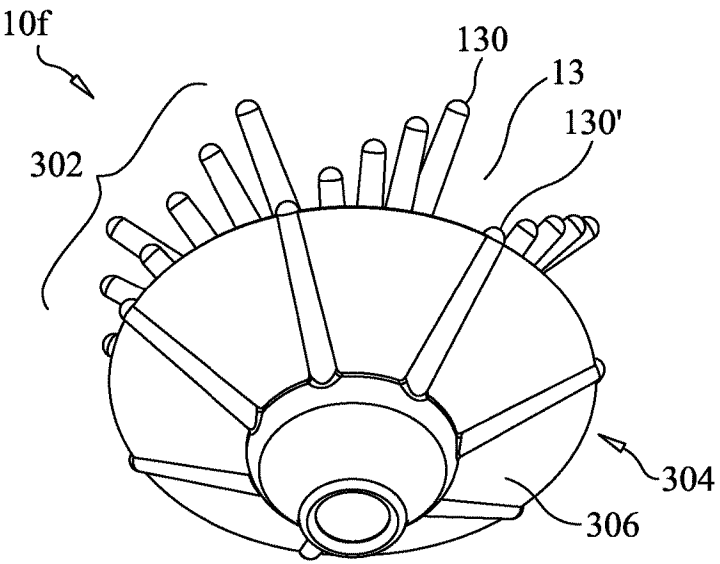
Figure 5C:
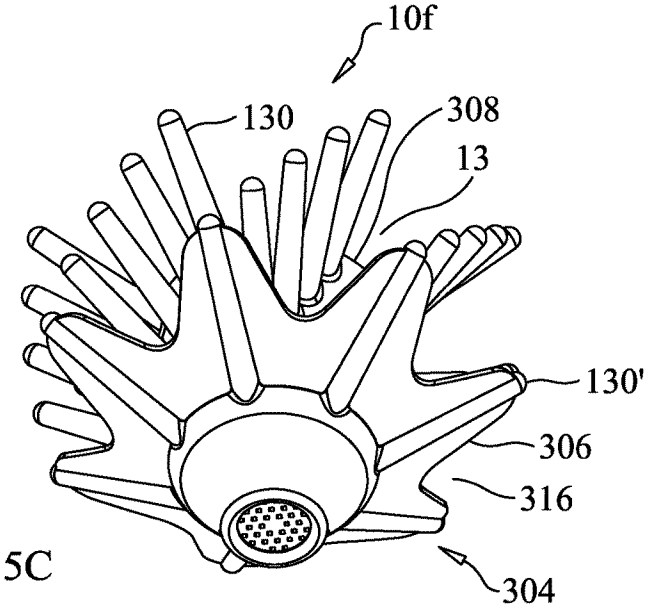

FIGS. 5A-5C are perspective views of variants of a securing mechanism 10*f* that includes a securing portion 302 and a sound blocking portion 304 that includes skirting 306, that can be used in embodiments of the present invention. Although the outwardly projecting members 130 used in FIGS. 5A-5C are of the type and arrangement of outwardly projecting members 20 shown in FIG. 2, it is noted that any of the other alternative embodiments of outwardly projecting members as described herein could be substituted in whole or in part, while maintaining air channels 13 to allow air flow between the walls of an inner space or opening and the securing portion 302 to provide benefits, such as being substantially more comfortable and allowing for longer wear time, maintaining air circulation within the ear canal, and/or minimizing the potential for development of hot spots that often occur in devices that block the ear canal.

In the embodiment of FIGS. 5A-5C, sound blocking portion 304 includes skirting formed by skirts 306 attached to outwardly projecting members 130'. Outwardly projecting members 130' may be of the same type and length as outwardly projecting members 130. Alternatively outwardly projecting members 130' may be of a different type that outwardly projecting members 130, including any of the other types and shapes of outwardly projecting members described herein. Further alternatively, the lengths of the outwardly projecting members 130' may be shorter than, longer than or equal to the lengths of the outwardly projecting members 130. For example, in the embodiment of FIG. 5A, where skirting 306 continuously fills the gaps between outwardly projecting members 130' so that the skirting 306 with the projecting members 130' forms a substantially continuous circle at the open end of the sound blocking portion 304 when in the relaxed configuration shown in FIG. 5A and no gaps exist between the projecting members 130' as the spaces that would otherwise exist between the projecting members 130' are closed by the skirting 306, the lengths of outwardly projecting members 130' may be shorter than the lengths of outwardly projecting members 130, so that when the securing mechanism 10*f* is inserted into an internal space or opening, the outwardly projecting members 130' deflect less, or not at all, relative to the amount of deflection of the outwardly projecting members 130, so that the outwardly projecting members 130 apply pressure to the internal walls that is greater than the pressure applied by projecting members 130' to the internal walls. Because the outwardly projecting members 130' deflect very little, if any, this prevents the occurrence of buckling of the skirting 304 that could cause it to not seal completely all the way around the internal walls 100. In this way, this embodiment is similar to the embodiment of FIG. 4 in the characteristic that the outside diameter (for a sound blocking portion 304 having a circular cross-section) or largest cross-sectional dimension of the sound blocking portion 304, in a direction normal to the longitudinal axis 15 of the securing mechanism 10*f*, when in a relaxed configuration as shown in FIG. 5A, can be significantly less than an outside diameter, or largest cross-sectional dimension, in a direction normal to the longitudinal axis 15, of the securing portion 302/outwardly projecting members 130 when in the relaxed configuration. Further alternatively, the angles formed by the outwardly projecting members 130 and 130' relative to the body 308 of the securing mechanism 10*f* may be different from one another.

FIGS. 5B-5C illustrate variants of securing mechanism 10*f* in which skirting 306 is attached to or integral with projecting members 130' in a manner that only a portion of the spaces between the projecting members 130' is filled when the blocking portion 304/securing mechanism 10*f* is in a relaxed/unbiased configuration, such that gaps 316 exist between skirting portions 306 in locations between the outwardly projecting members 130'. The outwardly projecting members 130' and skirting 306 are configured and dimensioned for a particular size of opening or internal space so that, when the securing mechanism 10*f* is inserted into the opening or internal space, the deflection of the outwardly projecting members 130' against the internal walls of the opening or internal space, cause the folding up of the skirting portions 306 to the extent that they partially overlap one another, as described and shown in the co-pending application incorporated by reference above. Thus, when the securing mechanism is inserted into the opening or internal space, the overlapping skirts 306 eliminate, or nearly eliminate the gaps 316 that exist between the skirts 306 in the relaxed configuration of FIG. 5B.

For uses where the opening or internal space is larger than the ones for which the embodiment of FIG. 5B are used, the embodiment of FIG. 5C provides skirting 306 that fills relatively larger areas of the spaces between the outwardly projecting members relative to the area filled by the skirting in FIG. 5B. Gaps 316 are still present in this embodiment, although the skirting 306 can optionally extend continuously between the outwardly projecting members 130' over a distal portion of the spaces.

Like the embodiment of FIG. 5A, the lengths of the outwardly projecting members 130' of the embodiments of FIGS. 5B-5C may be shorter than, longer than or the same length as the lengths of outwardly projecting members 130, and the angles of member 130' relative to the body of the securing mechanism may be greater than, equal to or less than the angles of the members 130 relative to the body of the securing mechanism. Unlike the embodiment of FIG. 5A however, the outwardly projecting members 130' are configured to bend or distort significantly, to the extent necessary to cause the skirts 306 to overlap one another so as to eliminate or nearly eliminate the gaps 316. Unlike the embodiments of FIGS. 2-3 which are configured to still allow some degree of air flow/sound through all rows of the outwardly projecting members/veins, the skirt configurations of FIGS. 5B-5C are designed to close off the flow of air/sound threrepast, when installed in an opening or internal space. Thus, the overlapping portions of the skirting contact one another and close off the flow of air/sound. In this embodiment, ambient sound is effectively prevented from passing through the overlapped skirting, but pressure equalization is permitted by the lack of a complete seal of the skirting relative to the ear canal, as contrasted with the substantially complete seal that the dome 204 or full skirting of FIG. 5A provides. This permits greater amplification, especially of lower frequency sounds directed from the space access device toward the tympanic membrane, as the skirting allows pressure buildup in the space between the skirting and the eardrum, but allows this pressure to gradually bleed off and equalize with the ambient pressure. As contrasted with open air designs which very rapidly equalize the pressure in the area of the tympanic membrane with the ambient pressure, these overlapping skirt designs slow down the pressure decrease of the pressure generated by sound entering the space between the skirting and the tympanic membrane, so that more force/sound is effectively transmitted to the tympanic membrane before the pressure equalizes.

To provide an even greater blocking of sound, the embodiments described herein may include more than one dome portion 204 or more than one row of outwardly projecting members 130' having skirting 306.

The present invention provides wax management systems designed to prevent wax migration into the working components of a hearing aid or other space access device and to help prevent audio degradation of signals provided by the hearing aid or other space access device. In the case of a hearing aid, the hearing aid will typically be provided with a filter, such as filter 69 (FIG. 1) provided at the distal end opening of the body 60 between the receiver 140 and the open space existing externally of the body 60. This filter is very difficult to change and requires significant time, expense and inconvenience to a user if it does need to be changed. Even worse, if wax or any liquid is allowed to migrate through this filter 69, this can result in damaging the receiver, in which case the entire hearing aid (or at least the receiver 140, although this is typically not economically feasible) may need to be replaced. The present invention provides a secondary filter as part of a wax management system that acts as a primary defense against wax migration in preventing wax from reaching the filter 69, and also increases protection against moisture or other fluids from reaching the filter 69. Because this secondary filter can be mounted in, or integral with a securing mechanism 10*c*, 10*d*, 10*e*, 10*f*, and because these securing mechanisms are removably mounted to a space access device, the securing mechanism can be readily removed so that the filter can be cleaned. Alternatively, the securing mechanism can be made as a disposable unit, so that a new securing mechanism can be mounted on the space access device and the old securing mechanism can be simply discarded, rather than being cleaned.

Figure 6:
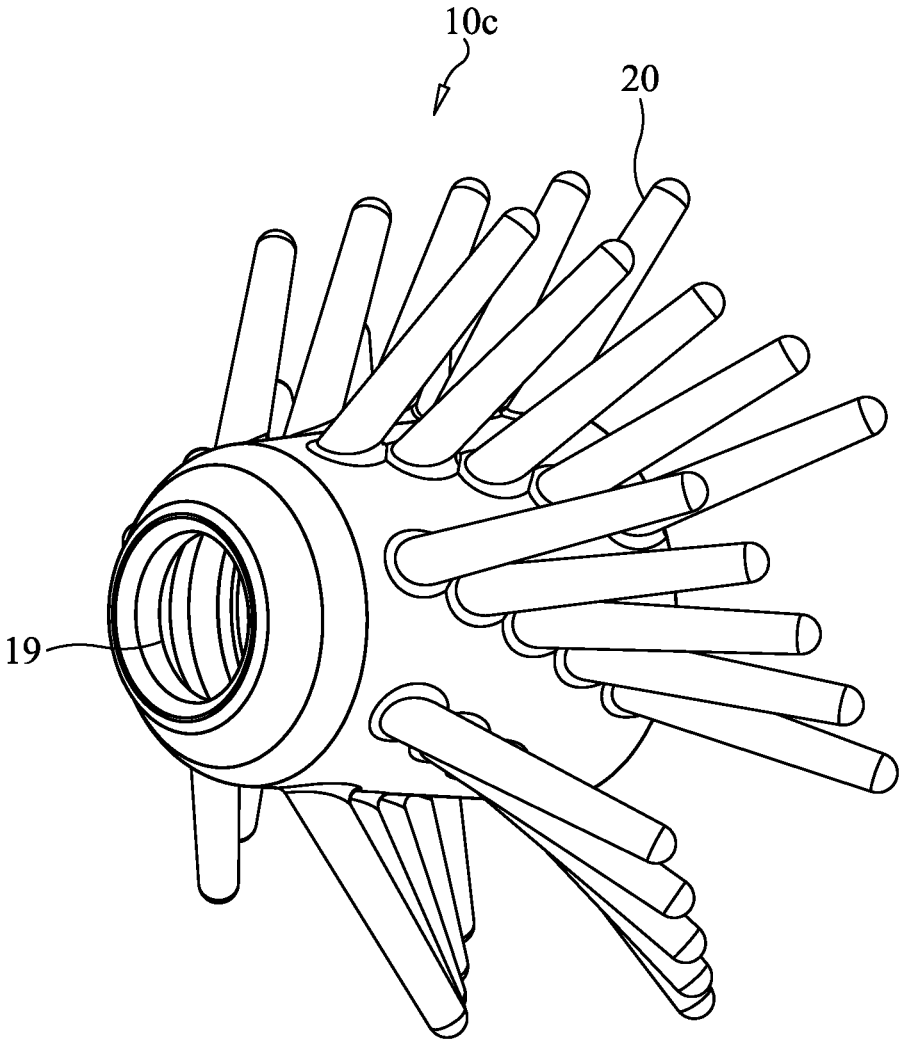
FIG. 6 illustrates an opening in a distal end of a securing mechanism according to an embodiment of the present invention.
Figure 7:
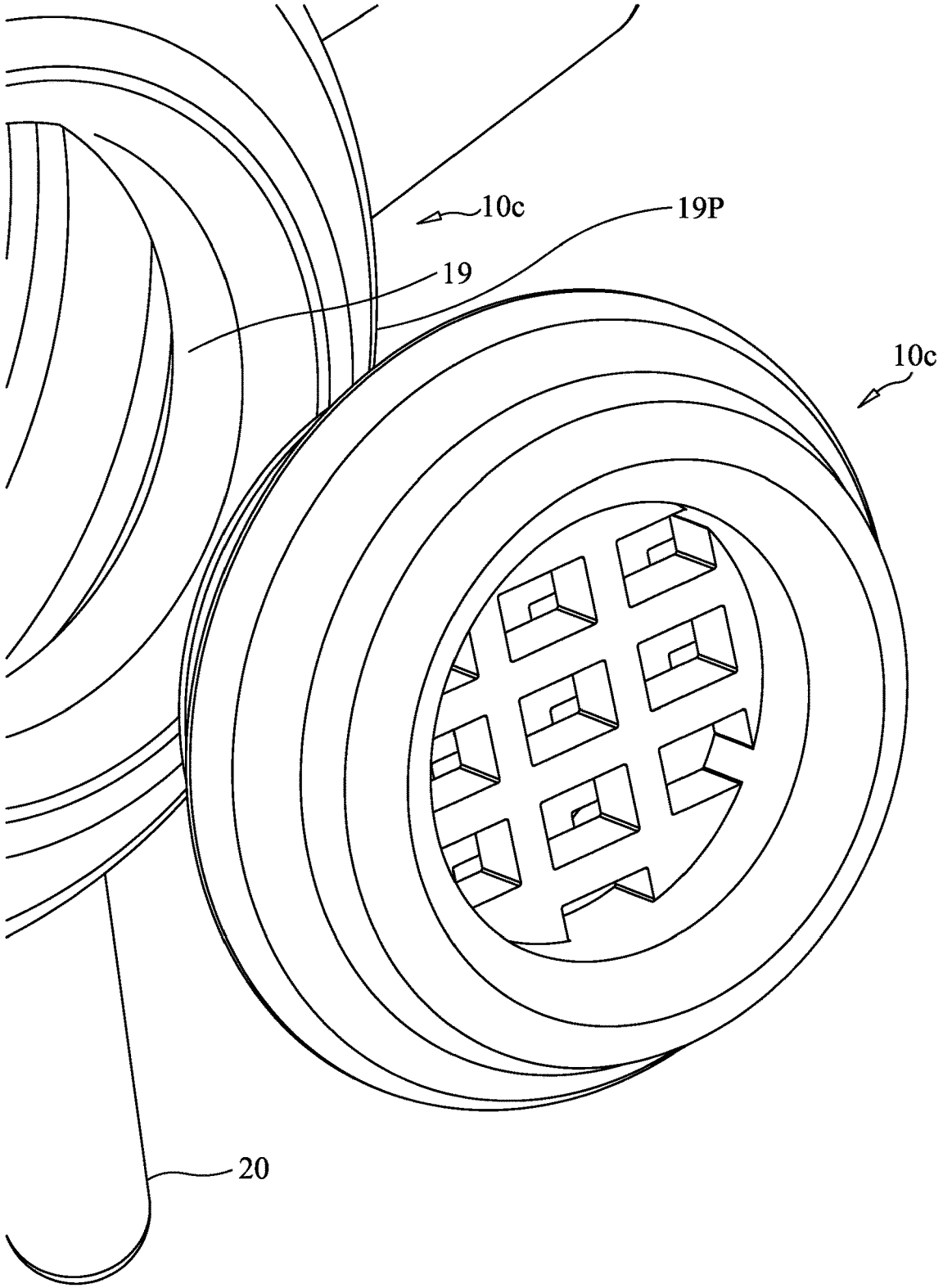
FIG. 7 is an exploded, partial view of a securing mechanism and guard according to an embodiment of the present invention.

The lumen 18, 248 of the securing mechanism 10*c*, 10*d*, 10*e*, 10*f* includes an opening 19 that opens to outside of the securing mechanism at the distal end thereof, e.g., see FIG. 6. This opening 19 aligns with the opening at the distal end of the space access device 64, so that, when space access device is a hearing aid, in ear headphone, or some other device that outputs sound, air and/or other fluid media, it passes out of the space access device, through the opening, and out past the distal end of the securing mechanism. A guard 1300 is configured and dimensioned to be inserted into the distal end portion of the securing mechanism, to close the opening 19, so that only openings provided in the guard 1300 exist as passageways to allow sound/airflow/other fluid media out of the distal end of the securing mechanism. FIG. 7 illustrates a guard 1300 according to an embodiment of the present invention that is configured and dimensioned to fit within the opening 19 of securing mechanism 10*c*. Is this embodiment, both the opening 19 and guard 1300 have a circular configuration each dimensioned so that the guard 1300 fits securely within opening 19 and closes it off. These components may be dimensioned so that the guard 1300 snaps into position in the opening with a snap or friction fit. Preferably, the guard 1300 is bonded into position in the opening 19, using silicone or other adhesive.

Figure 8A:
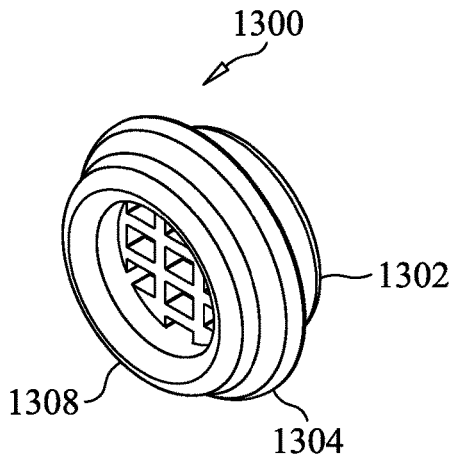
FIG. 8A is a perspective view of a guard according to an embodiment of the present invention.
Figure 8B:
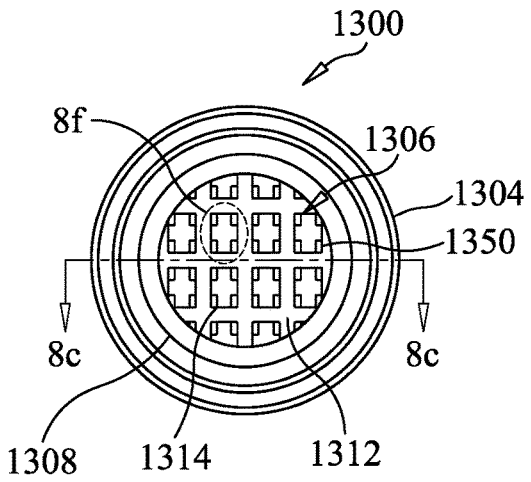
FIG. 8B is a distal end view of the guard of FIG. 8A.
Figure 8C:
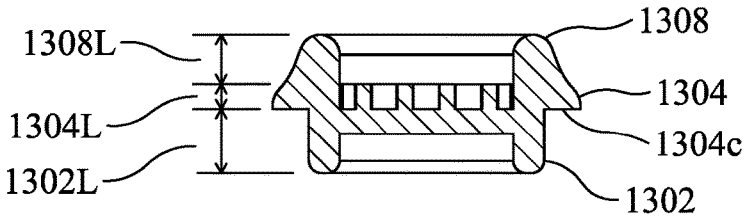
FIG. 8C is a longitudinal sectional view of FIG. 8B taken along line 8C-8C.

FIG. 8A shows a perspective view of guard 1300 according to an embodiment of the present invention. A proximal end portion 302 of the guard functions as an insert portion and is configured and dimensioned to slide within the opening 19. Preferably the outside diameter (or outside dimensions, if the portion is non-circular in cross-section) of the insert portion 1302 is/are the same as or slightly less than the inside diameter (or inside dimensions, if the opening is non-circular) of the opening 19, so as to form a close fit, but this is not absolutely necessary. An enlarged sealing portion 1304 extends from the proximal end portion 1302 and has the largest outside dimensions of any portion of the guard 1300. The sealing portion is configured and dimensioned to overlay the perimeter structure 19P surrounding the opening 19 and form seal therewith, in this embodiment, which can be performed by sealing with silicone or other adhesive. The sealing portion 1304 has a contact surface 204C that forms a shoulder relative to the outer surface of the insertion portion 1302, as illustrated in FIG. 8C. A filter portion 1306 is surrounded by the main body of the guard 1300, typically at about the level where the sealing portion 1304 is formed. A berm 1308 is formed at the distal end portion of the guard 1300 and around the periphery of the filter portion 1306 when viewed toward a distal end, as illustrated in FIG. 8B. In at least one embodiment, where the guard is circular cross-section, as in the embodiment shown in FIGS. 8A-8C, The outside diameter of sealing portion was about 3.15 mm and the inside diameter of berm 1308 was about 1.78 mm, which is also the outside diameter of the filter portion 1306. These dimensions may, of course, vary; the outside diameter of the sealing portion may be in a range from about 2.0 mm to about 4.5 mm, typically from about 2.75 mm to about 3.5 mm and the inside diameter of the berm may be in a range from about 0.8 mm to about 3 mm, typically from about 1.25 to about 2.5 mm. In at least one example, the length 1302L of the insert portion was about 0.66 mm, the length 1304L of the sealing portion was about 0.25 mm, and the length 1308L of the berm was about 0.52 mm. However, each of these lengths may vary.

Figure 8D:
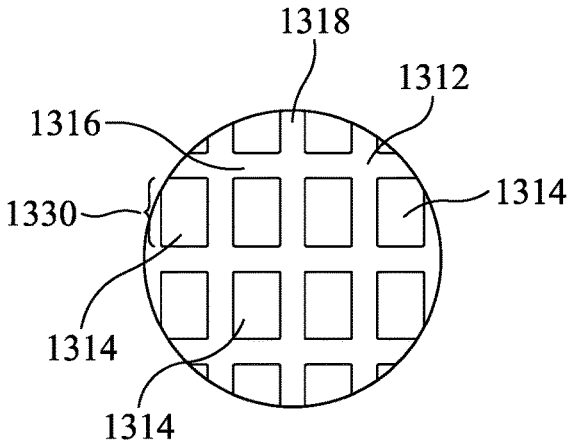
FIGS. 8D and 8E are views of first and second plates employed in the guard of FIGS. 8A-8B.
Figure 8E:
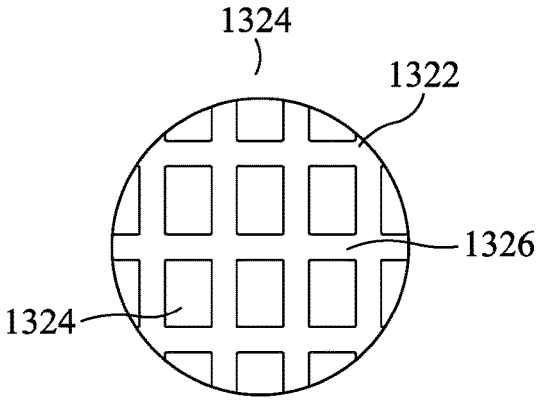

The filter portion 1306 of the embodiment shown in FIGS. 8A-8C is a waffle design filter portion made up of a pair of plates 1312, 1322 both having a plurality of openings 1314, 1324, respectively, therethrough. FIGS. 8D and 8E show the distal-more (outer) plate 1312 and the proximal-more (inner) plate 1314, respectively. Only the outer plate 1312 is shown in FIG. 8B, as it overlies the inner plate 1314 when assembled. The only portions of plate 1322 that are visible in FIG. 8B are the cross-shaped structures that appear in the centers of the openings 1314. As shown in FIGS. 8D and 8E, the openings 1314, 1324 are rectangular in shape, but other embodiments may have openings 1314,1324 of other shapes, including, but not limited to, square, triangular, circular, oval, elliptical, other polygonal, or irregular. Currently, rectangular and square shaped embodiments are preferred.

Figure 8F:
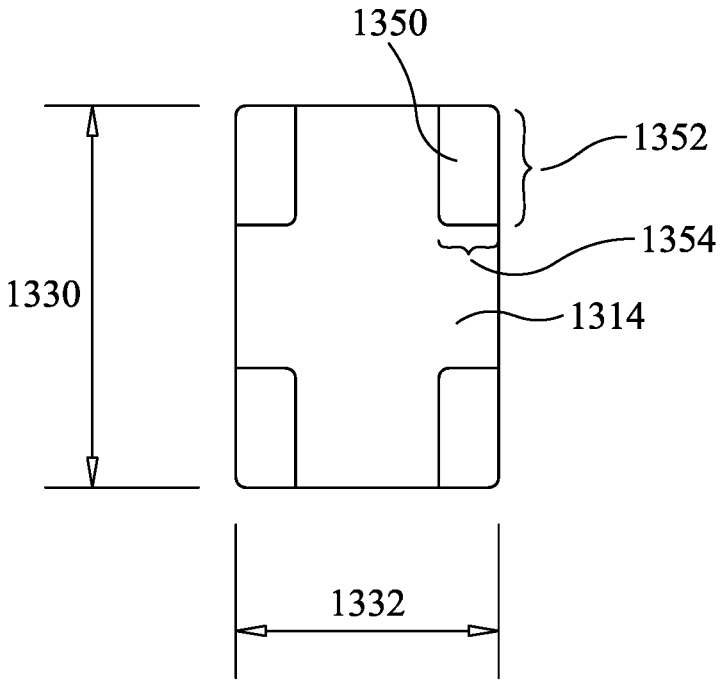
FIG. 8F is an enlarged view showing an opening and apertures of the guard of FIGS. 8A-8B.

The openings 1314 in plate 1312 are arranged in a regular pattern of rows and columns separated by row spacings of equal heights 1316 and column spacings of equal widths 1318. The openings 1324 in plate 1322 can be of the same size, shape and orientation as those of openings 1314 in plate 1312 and can be separated by row spacings 1318 of equal height which are equal to the heights of row spacings 1316 and by column spacings 1328 of equal width equal to the column spacing widths 1318. However, the positions of openings 1324 on plate 1322 in the X and Y directions (width and height directions), respectively, are offset relative to the positions of the openings 1314 on plate 1312 in the X and Y directions, by a distance in the Y (height) direction equal to the height 1330 of opening 1314 minus the height 1352 of aperture 1350 (see FIG. 8F), and by a distance in the X (width) direction equal to the width 1332 of opening 1314 minus the width 1354 of aperture 1350. By offsetting the openings 1324 relative to the openings 1314 as described, upon overlaying plate 1312 on plate 1322, this results in the configuration shown in FIG. 8B, wherein only small apertures 1350 pass through the assembled filter 1306 (comprising plates 1312 and 1322 stacked together in contact). In alternative embodiments, the rows and/or columns of openings do not need to be regularly spaced, or even the same size and/or shape from one plate to the other, as long as the overlaying of the plates 1312, 1314 results in apertures as described. The shapes and/or sizes of the openings 1324 in plate 1322 can be different from the openings 1314 in plate 1312 and still produce the apertures 1350 as described, upon overlaying the plate 1312 on plate 1322.

Figure 8G:
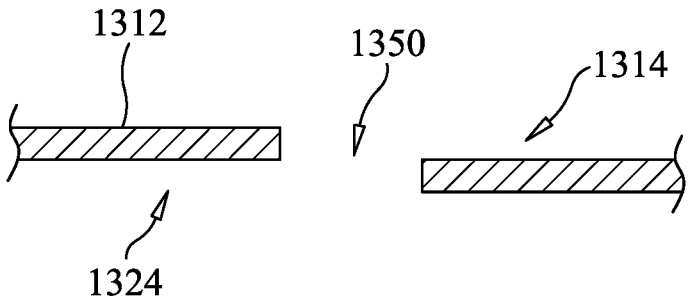
FIG. 8G is a cross-sectional view of an aperture and portions of the first and second plates of the guard of FIGS. 8A-8B.

FIG. 8G. is a cross-sectional illustration of portions of plates 1312 and 1314 for the purpose of illustrating formation of an aperture 1350 by the same. As can be seen, the plates 1312, 1314 are on adjacent, but different planes, so that the aperture 1350 is not formed by a tubular or other enclosed structure on any one plane parallel to or coplanar with the planes of the plates 1312, 1314. This greatly decreases, if not eliminates capillary action on any wax or liquid in the vicinity of aperture 1350 that would otherwise occur if aperture 1350 were formed as a tubular structure, such as by laser drilling through a plate or other manner of making a tubular aperture. Aperture 1350 has two perimeter walls formed by plate 1312 on one side of the aperture 1350, with two opposite perimeter walls formed by plates 1314 on the opposite side of the aperture 1350 and in a different plane, since plate 1314 is in a different plane from plate 1312.

Additionally, the cross-sectional dimensions of openings 1314 and 1324 are much greater than the cross-sectional dimensions of the apertures 1350. This results in the walls of the openings 1314 and 1324 being much greater in length and width than the lengths and widths of the apertures, which provides a much greater amount of surface area that is exposed to wax, so that no capillary action occurs relative to the large openings 1312, 1322. Also, the opening perimeters of openings 1312 provide large lengths and widths of surface edges that may interact with the wax preferably and with greater attraction than any that may occur with the underlying perimeters of openings 1322, further preventing migration of wax through apertures 1350. The smallest cross-sectional dimension of opening 1314, 1324 may be at least twice as great as the largest cross-sectional dimension of aperture 1350, or at least three times as great, or at least four times as great or in a range of 1.5 to 12 times as great, preferably in a range from about 3 to 10 times as great, more preferably in a range from about 4 to about 8 times as great. In at least one embodiment, apertures 1350 are rectangular, each having a length of about 0.120 mm and a width of about 0.060±0.025 mm and openings 1312, 1322 are rectangular, each having a length of about 0.41 mm and a width of about 0.28 mm. The thickness of each plate may be in a range from about 0.1 mm to about 1 mm, typically from about 0.2 mm to about 0.5 mm. In one example, the thickness was about 0.25 mm. The cross-sectional area of aperture 1350 is less than 25 percent of the cross-sectional area of opening 1314 or 1324, preferably less than 15 percent, and may be in a range from about 15 percent to about 2 percent, typically from about 10 percent to about 3 percent. In one example the cross-sectional area of aperture 1350 was about 6.27 percent of the cross-sectional area of opening 1314 and about 6.27 percent of the cross-sectional area of opening 1324. In another example, the cross-sectional area of aperture 1350 was about 3.66 percent of the cross-sectional area of opening 1314 and about 3.66 percent of the cross-sectional area of opening 1324. In the embodiments shown, the apertures 1350 are formed in the four corners of the openings 1314, 1324, and portions of the plates 1312, 1314 obstruct the remainders of the openings, as the plate 1312 is overlaid on plate 1324 and the plates are contacted together as described. The distance between apertures 1350 is typically at least two to three times the greatest cross-sectional dimension of the aperture 1350, and may be in a range of 1.25 to about 6 times the greatest cross-sectional dimension, typically in a range of from about 1.75 to about 4 times the greatest cross-sectional dimension. The berm 1308 extends in a direction perpendicular to and away from the plate 1312 by a distance 1308L in a range from about 0.25 mm to about 1.0 mm, typically in a range from about 0.5 mm to about 0.75 mm. This results in a dish-shaped distal end portion of guard 1300, as shown in FIG. 8A. This configuration helps to prevent physical contact with the plate 1312, as the berm 1308 guards it. Also, the internal walls of the berm provide additional surface to which wax can be attracted and prevented from migrating to the apertures 1350.

Figure 9:
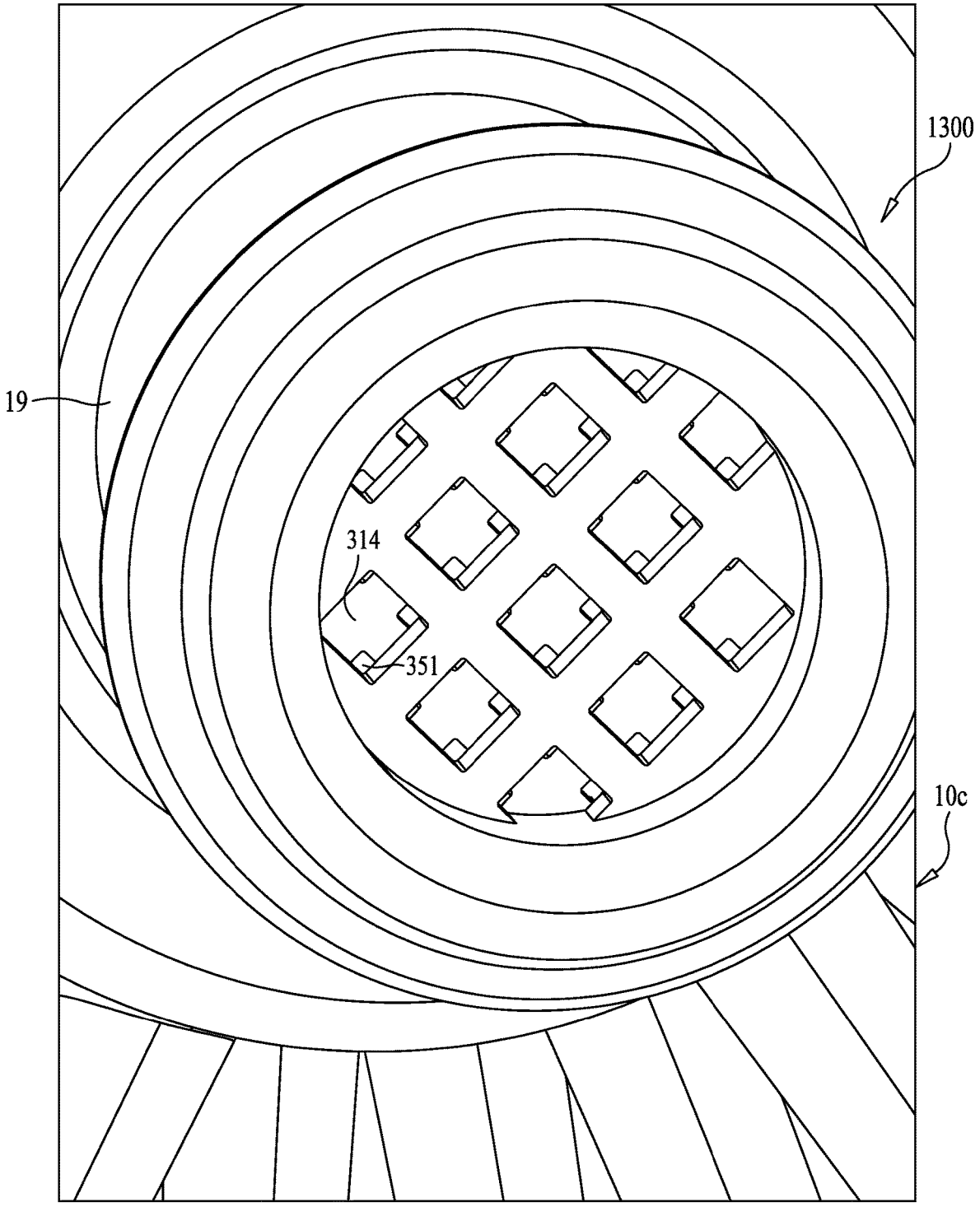
FIG. 9 is an exploded, partial view of a securing mechanism and guard according to another embodiment of the present invention.
Figure 10:
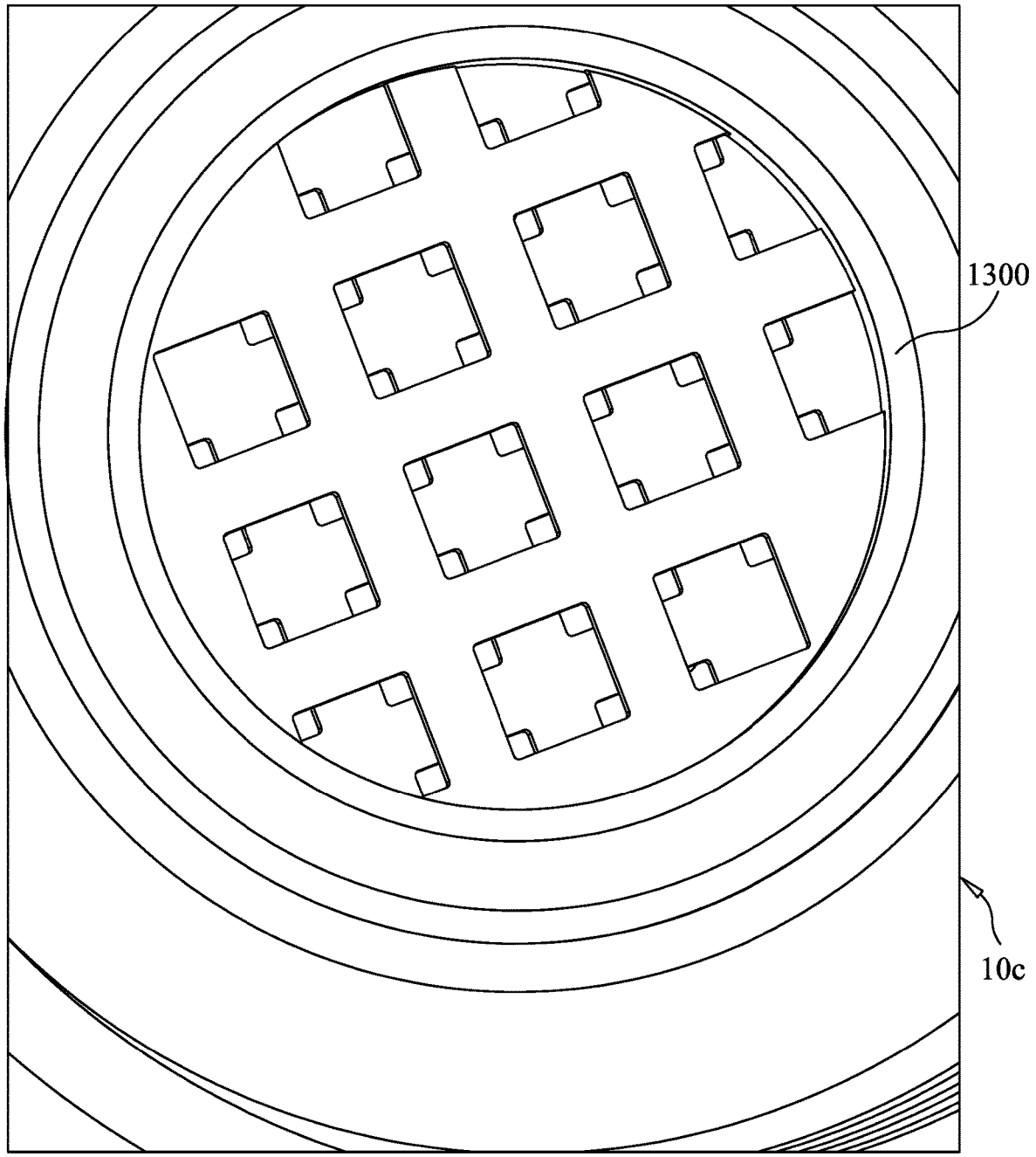
FIG. 10 shows the guard of FIG. 9 secured to the securing mechanism.

FIG. 9 shows an embodiment of guard 1300 in which apertures 1350 are square in shape and also openings 1314 and 1324 are square in shape. FIG. 10 shows the guard 1300 of FIG. 9 having been installed on securing mechanism 10*c* in a manner as described above. Regardless of the shapes and sizes of the openings 1314, 1324 and apertures 1350, the plates 1312, 1314 can be made of various different materials, including, without limitation, silicone, rubber, latex, polyurethane, polyamide, polyimide, nylon, paper, cotton, polyester, polyurethane, hydrogel, plastic, feather, leather, wood, and/or shape memory alloy, such as NITINOL®, metals, such as stainless steel, titanium or the like. Silicone is currently the preferred material. Advantageously, the plates 1312, 1314, as well as the remainder of the guard 1300 can be made of the same material that the securing mechanism 10*c*, 10*d*, 10*e*, 10*f* is made from, thereby reducing costs of production and simplifying the production of the invention. Also, since the openings 1312, 1314 need not be particularly small, laser drilling is not required, and the plates 1312, 1314 can be molded when made of polymer or other moldable material, still further reducing costs and time of production, while still providing the ability to produce the resultant apertures 1350 that are very small, without the need for laser drilling.

Figure 11A:
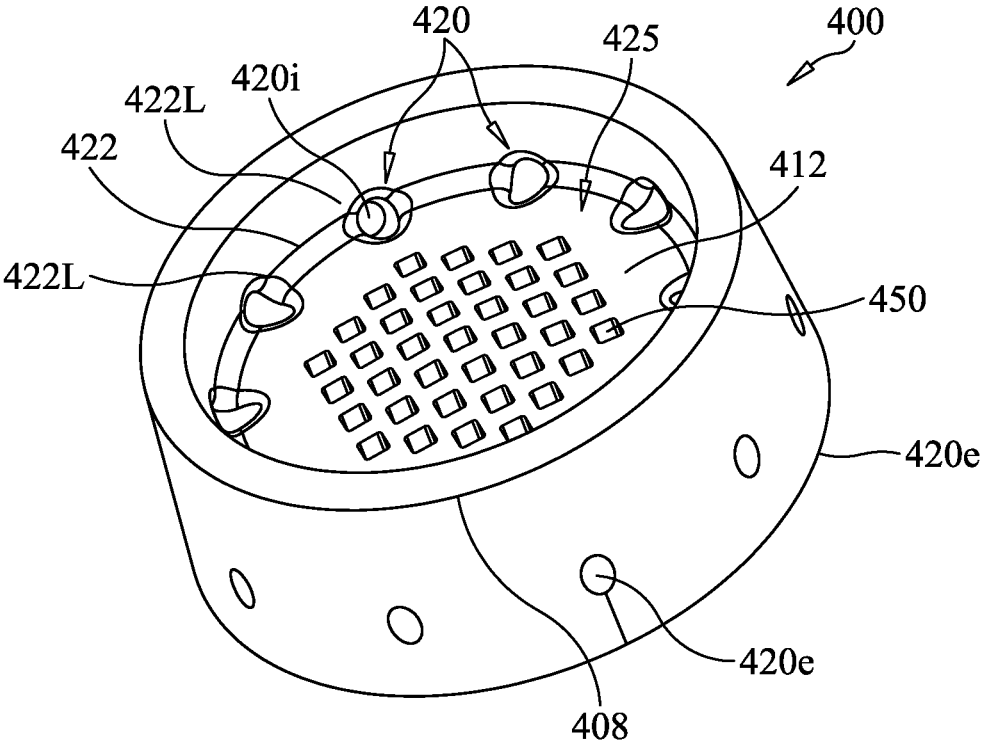
FIG. 11A is a perspective view of a guard according to another embodiment of the present invention.

FIG. 11A is a perspective view of a guard 400 according to another embodiment of the present invention. Guard 400 can be made of any of the same materials described above with regard to guard 1300 and by any of the same techniques. Although it is preferred that guard 400 employ plates 1312, 1314 to provide apertures 1350 in the same manner as described above, this is not required, and the embodiment of FIG. 11A shows an alternate arrangement in which only a single plate 412 is used to make larger apertures 450 (relative to the size of apertures 1350). Furthermore, any plate or central configuration providing through apertures of any sort can be employed with the additional inventive features described in this embodiment. Gutters 420 are formed in the main body of the guard 400 and are configured to guide and channel wax flow from inside the bowl region 425 of the guard 400 to locations external of the guard 400. Inlets 420I of the gutters are formed at the perimeter of plate 412 where it joins the inner walls of the berm 408. Channels 422 may be formed between the gutter inlets 420I along the locations where the plate 412 joins the berm 408 inner walls to further help guide the flow of wax to the gutter inlets 420I. Further optionally, the channels 422 may be configured to slope from a highest location 422H intermediate the length of a channel 422, to lowest locations 422L where the channel 422 meets the gutter inlets 422I.

The gutters 420 slope downwardly and outwardly from the gutter inlets 422I to gutter outlets 422E located on the external walls of the guard 400 at locations below the level of the plate 412, as shown in FIG. 11A. The gutters 420 are preferably formed as straight, tubular formations, but need not be straight or tubular. The inside diameter of the gutter 420 preferably remains constant from the inlet 420I to the outlet 420E. Alternatively, the inlet 420I can be flaring, so as to be largest at its open end and tapering to the inside diameter of the gutter that passes through the guard 400. Further alternatively, the gutter 420 may increase in inside diameter as it extends from the inlet 420I to the outlet 420E, or only a portion of the gutter 420 may increase in a direction toward to the outlet. In any case, the inside diameter of the outlet 420E is generally equal to or greater than the inside diameter of the inlet 420I. The inside diameter of the inlet 420I is greater than the greatest cross-sectional dimension of any aperture 450, so that the gutter inlets 420I provide less resistance to wax flow than that provided by the apertures 450, so as to encourage wax flow through the gutters 420 and away from the apertures 450. The inside diameter of the gutter inlets 420I, as well as the gutters 420 is greater than the greatest cross-sectional dimension of an aperture 450, 1350, and may be in the range of 1.1 to 5 times as great.

Figure 11B:
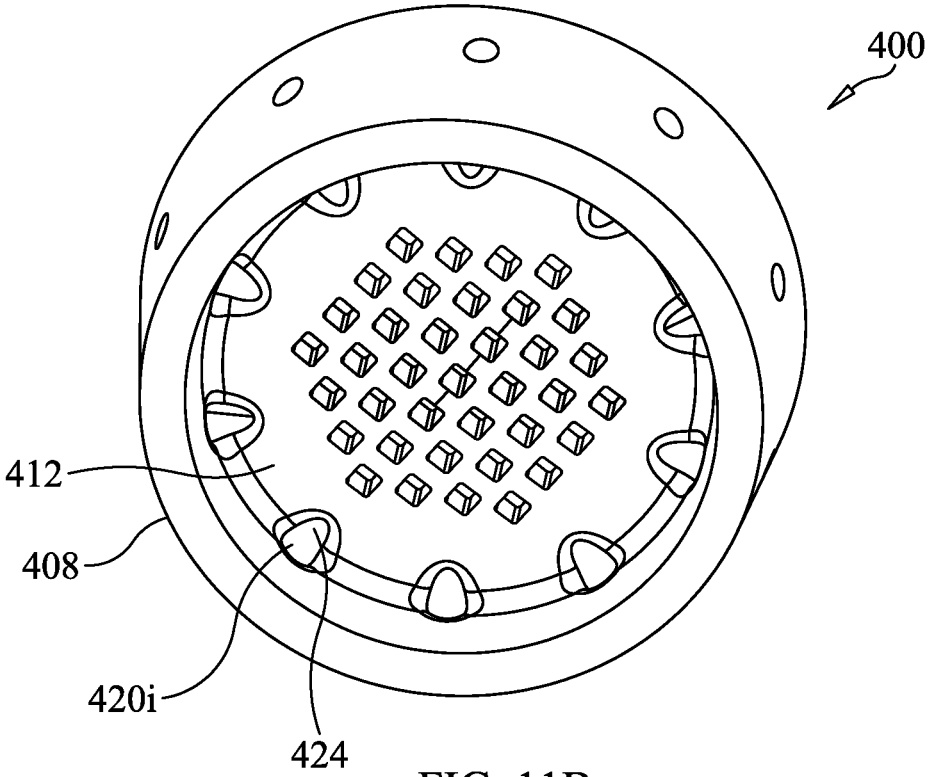
FIG. 11B is another view of the guard of FIG. 11A showing the distal end thereof.

FIG. 11B is a distal end view of the guard 400 shown in FIG. 11A. FIG. 11B better shows trenches 424 that extend from inlets 420I, and which are tapered to form a gradient along the trench from a level of the plate 412 down into the inlet 420I. This further encourages and channels wax flow from the plate 412 to the inlets 420I. As shown in FIG. 11B, guard 400 has ten gutters 420 with gutter inlets 420I equally radially spaced about the circumference of the plate 412. However, this is just one example, and more or fewer gutters 420 could be provided in a guard without departing from the principles of the present invention.

Figure 11C:
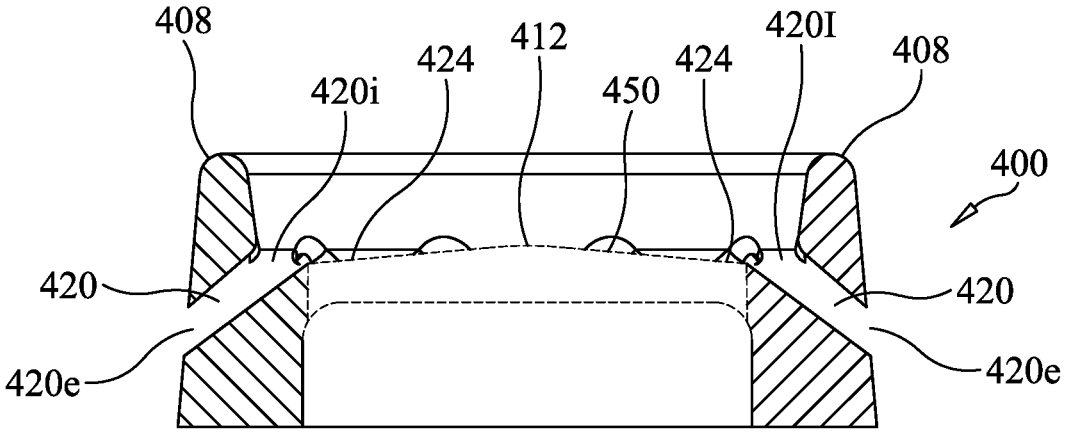
FIG. 11C is a longitudinal sectional view of the guard of FIGS. 11A-11B.

FIG. 11C is a longitudinal sectional illustration of guard 400 showing the downsloping trajectory of gutters 420 from the inlets 420I to the outlets 420E. Channels 424 can also be seen sloping from the plate 412 upper surface to the inlet 420I. The gutters 420 provide the paths of least resistance for wax flow from the bowl shaped interior of the distal end portion of the guard 400 to locations external of the guard 400 and help to keep wax from accumulating in the vicinities of the apertures 450. In this way wax flow is diverted from the apertures 450 to the large gutter inlets 420I and out of the guard 400 through the gutters 420 and out of the outlets 420E.

Figure 12A:
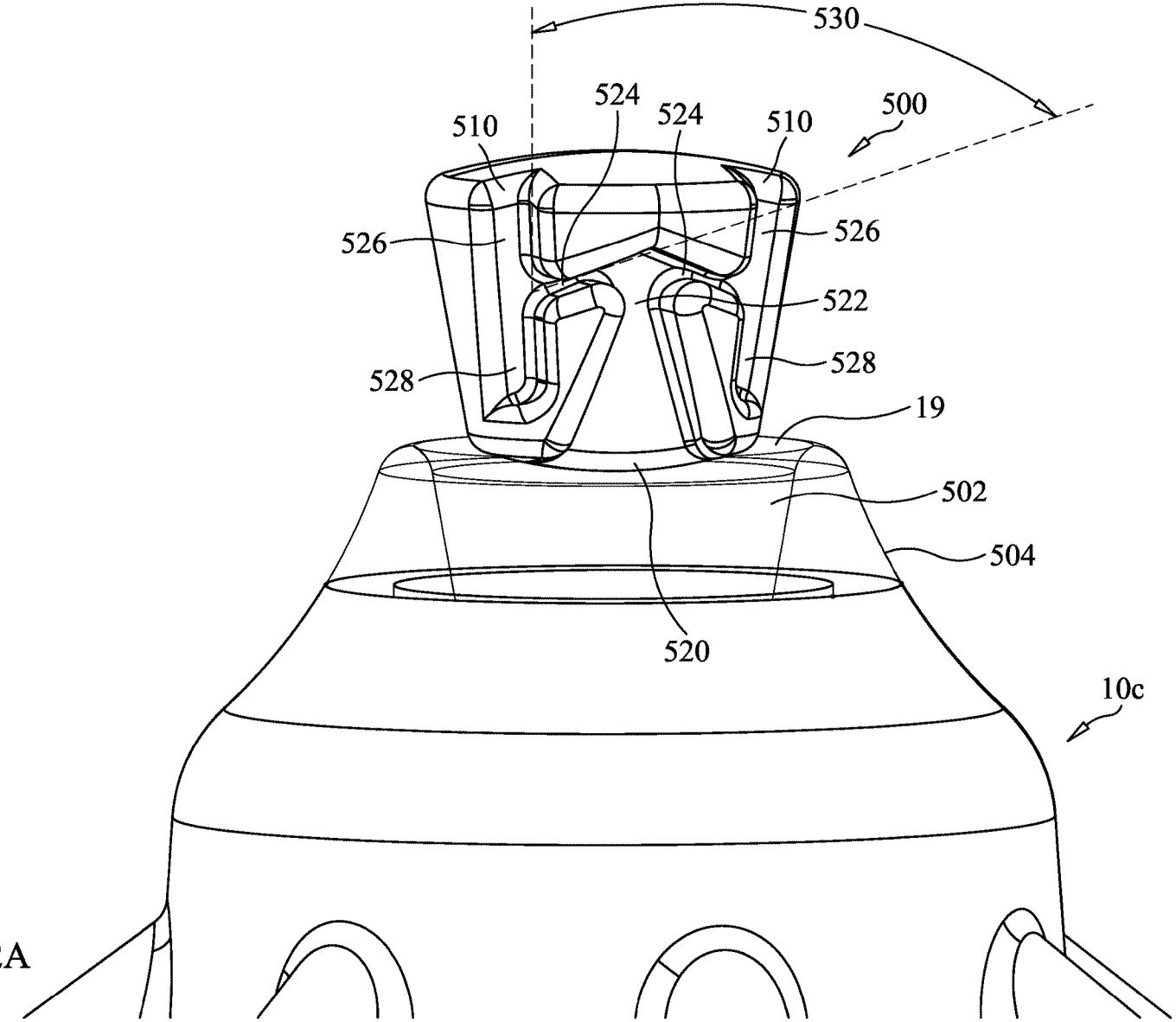
FIG. 12A is a side view of a guard and a partial view of a securing mechanism according to another embodiment of the present invention.
Figure 12B:
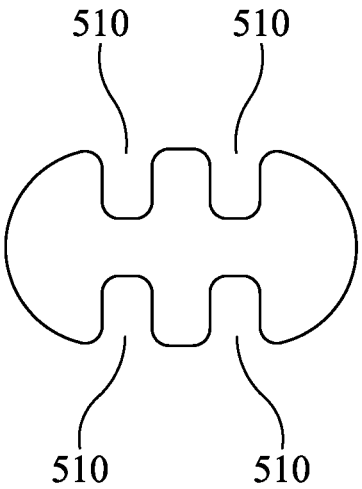
FIG. 12B is a top view of the guard of FIG. 12A.
Figure 12C:
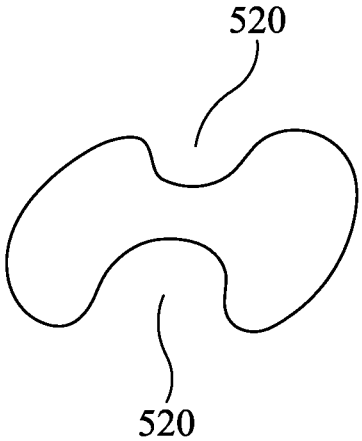
FIG. 12C is a bottom view of the guard of FIG. 12A.

FIG. 12A is a side view of a guard 500 according to another embodiment of the present invention. The body of guard 500 can be configured and dimensioned to fit within the opening 19 of securing mechanism 10*c*, 10*d*, 10*e*, 10*f*. In this embodiment, a proximal end fitting portion or shell 502 and the opening 19 have a circular cross-sectional configuration. The shell 502 can be bonded to or integral in the opening 19 and is shaped so that the guard 500 fits securely therein, with the walls of the shell 502 acting as parts of the walls of the passageways 522, 524, 526, 528 formed in guard 500. Sealing ring 504 facilitates the sealing of guard 500 within the opening 19/shell 502 in the same way as described above for sealing guard 1300 using sealing portion 1304, wherein the components 502, 504 and 500 fill the opening 19 and close it off. Further as shown, guard 500 body can be tapered to form a cork-like configuration that fits into the opening 19 like a cork fits into the opening of a bottle or container. These components may be dimensioned so that the guard 500 snaps into position in the opening with a snap or friction fit. Preferably, the guard 500 is bonded into position in the opening 19, using silicone or other adhesive. FIG. 12B is a top view of the guard 500 of FIG. 12A, showing sound exit ports 510 and FIG. 12C shows a bottom view of the guard 500 of FIG. 12A showing sound entrance ports 520. Upon installation of the guard 500 in securing mechanism 10*c*, 10*d*, 10*e*, 10*f* to a hearing aid housing 60, for example, sound entrance ports 520 are positioned adjacent receiver 140 and aligned therewith to receive sound waves to be transmitted through the guard 500 and out of the sound exit ports 510. There are no straight through openings or pathways through the guard. Rather, the sound travels through a labyrinth of passageways as described in more detail below.

FIG. 12A illustrates the pathways of the labyrinth provided. The pathway has the largest cross-sectional area at the location of the sound entrance port 520 (only one shown in FIG. 12A, but another port 520 is on the back side, not visible in FIG. 12A) and funnels down to a smaller cross sectional area 522 at a junction with cross paths 524. Cross paths 524 join with exit paths 526 at the opposite ends thereof. Exit paths 526 end at sound exit ports 510 that open to the top end of guard 500 where they output sound to the tympanic membrane, for example. Exit paths 526 are larger in cross-sectional area than the cross-sectional areas of cross paths 524, but are typically smaller in cross-sectional area than the cross-sectional area of sound inlet port 520. The exit paths 526 may extend substantially in a longitudinal direction from top towards the bottom of the guard. The exit paths 526 extend past and below their junctions with the cross paths 524 to form wax repositories 528 as extensions of the exit paths 526. The cross-sectional dimensions and areas of the wax repositories 528 can be essentially the same as the cross-sectional dimensions and areas of the exit paths 526, as they can essentially be extensions of the same pathways, that extend down past the cross paths 524. Because the wax repositories 528 having significantly larger cross-sectional areas than the cross-sectional areas of the cross paths 524, and because the wax repositories 528 are reached simply by straight through travel of the wax from the sound exit ports 510 and the exit paths 526 to the wax repositories, wax flow is encouraged into the wax repositories and away from the junctions of the sound exit paths 526 with cross paths 524. The cross-sectional area of cross path 524 is less than the cross-sectional area of exit path 526/wax repository 528, as noted, typically less than 90% of the cross-sectional area of 526,528, or less than 80% or less than 75% or less than 67%, or less than 60%, or less than 50% or less than 40% or less than 30% or less than 25%.

Additionally, the cross path 524 may join the sound exit path 526 at an acute angle 530 as shown in FIG. 12A, such that the tracjetory of cross path 524 in a direction from the sound exit path 526 toward the junction 522 is on an uphill trajectory, relative to the transverse axis of guard 500 as shown. Because of this arrangement, the direction in which the wax must travel to enter the cross path 424 has to have a reverse vector component along the longitudinal direction i.e., the wax, if considered to be travelling "downward" in its travel into the wax repository 528, must travel along an "upward" trajectory to travel along cross path 524. This additionally prevents wax from entering cross path 524 as the wax flow will tend to travel along the past of least resistance.

Figure 13:
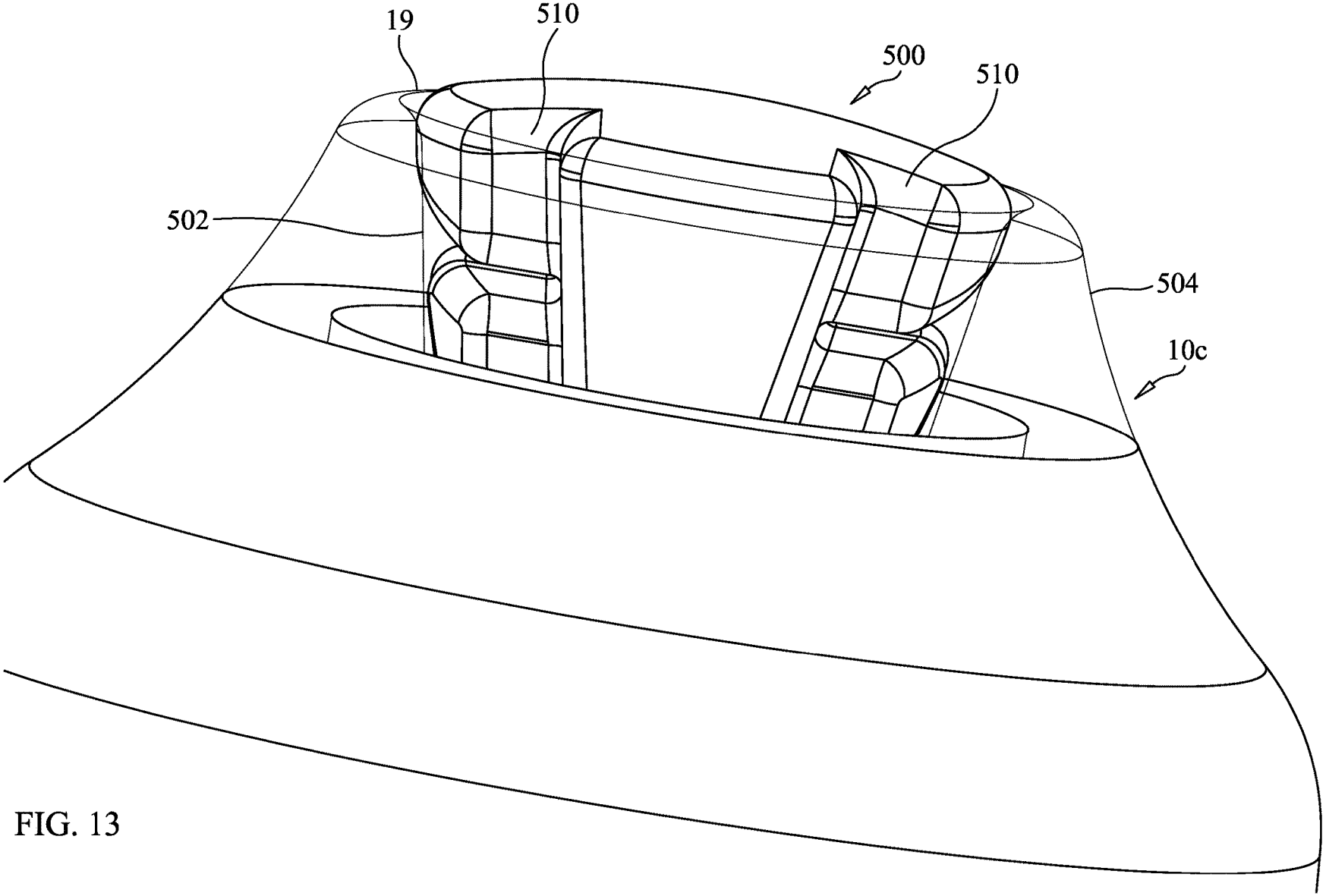
FIG. 13 shows the guard of 12A assembled in the securing mechanism, according to an embodiment of the present invention.
Figure 14:
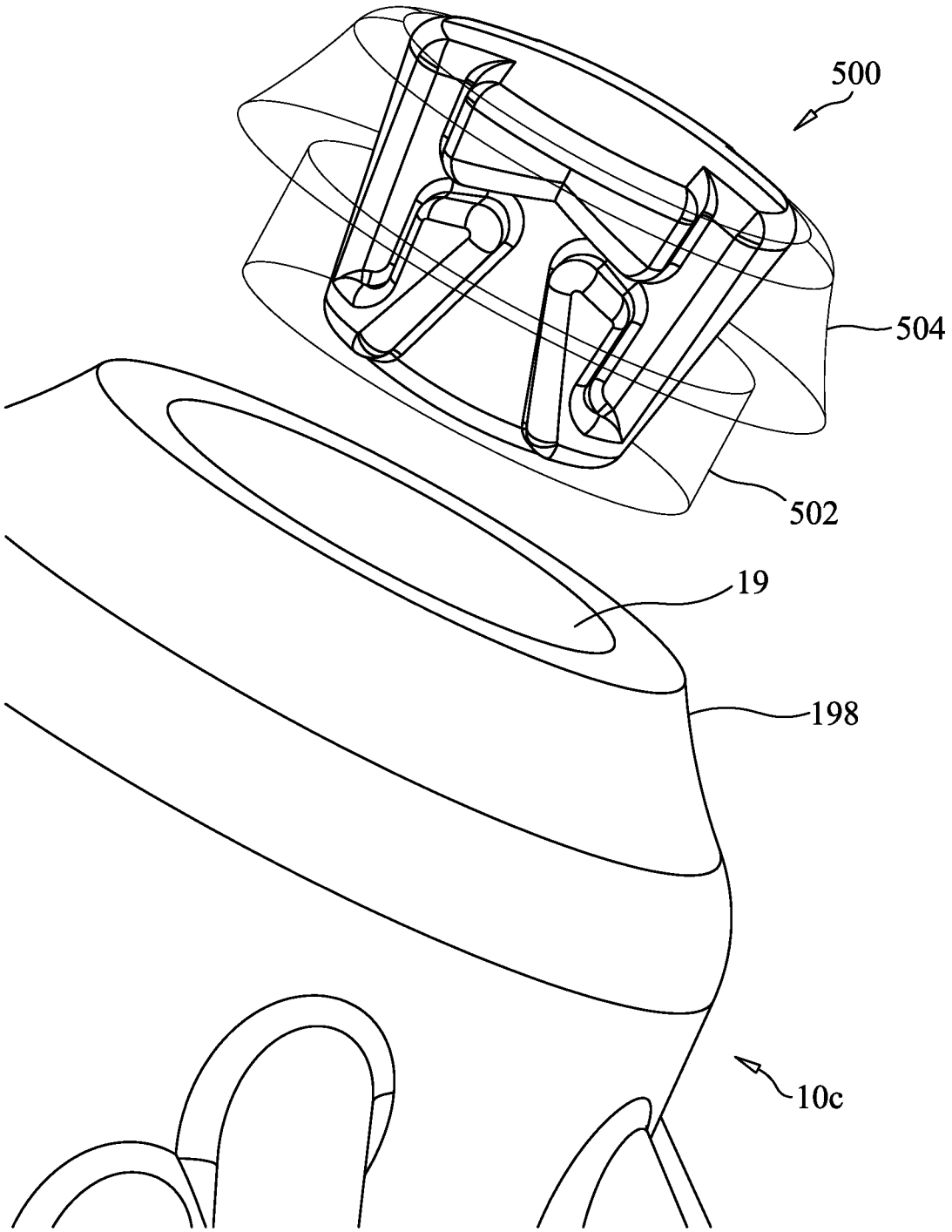
FIG. 14 is an exploded view of the assembly of FIG. 13.

FIG. 13 shows the components 500, 502 and 504 in their fully assembled state where they can be bonded to form the finished product. FIG. 14 is an exploded view illustrating the components 500, 502 and 504. Portion 504 has the largest outside dimensions of any portion of the components 500, 502, 504. The sealing portion 504 is configured and dimensioned to overlay the perimeter structure 19P surrounding the opening 19 and form seal therewith, in this embodiment, which can be performed by sealing with silicone or other adhesive.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

That which is claimed is:

1. A guard for a space access device configured to output air flow through a distal end portion thereof, said guard comprising:

a housing having a proximal end opening and a distal end opening, wherein said proximal end opening is configured to be placed nearer than said distal end opening to the output of air flow from the distal end portion of the space access device; and a filter portion positioned in said housing between said proximal and distal end openings, said filter portion comprising:

a distal surface, a proximal surface and a thickness, a first opening formed in said distal surface and extending into a first portion of said thickness; and a second opening formed in said proximal surface and extending into a second portion of said thickness;

wherein said first opening overlays said second opening to form an aperture that extends through said thickness;

wherein said first opening has a first cross-sectional area, said second opening has a second cross-sectional area and said aperture has a third cross-sectional area; and wherein said first cross-sectional area is greater than said third cross-sectional area and said second cross-sectional area is greater than said third cross-sectional area;

said guard attached to a securing mechanism, said securing mechanism comprising:

a base comprising a longitudinal axis and an outer surface; and an adjustable securing mechanism disposed on at least a portion of said base, said securing mechanism being configured to contact a surface of an internal space or opening into which said securing mechanism is inserted;

said adjustable securing mechanism being configured for positioning and maintaining said base at a distance from a location along the internal space or opening; and wherein a least a portion of said adjustable securing mechanism being configured to transition from a first state to a securing state when inserted into the internal space or opening, said securing state comprising at least a portion of said adjustable securing mechanism being constrained to have a smaller cross-sectional diameter relative to a cross-sectional diameter in said first state; and wherein said adjustable securing mechanism comprises a plurality of members configured to contact a wall of the internal space.

2. The guard of claim 1, wherein a perimeter of said aperture is formed by a first perimeter portion formed by a portion of a perimeter of said first opening and a second perimeter portion formed by a portion of a perimeter of said second opening.

3. The guard of claim 2, wherein said perimeter of said aperture is completely formed by said first and second perimeter portions, and wherein each of said first and second perimeter portions are continuous portions.

4. The guard of claim 2, wherein said first and second perimeter portions are on adjacent, parallel, but different planes, so that the said aperture is not formed by a tubular or other enclosed structure on any one plane parallel or coplanar with the parallel planes of said first and second perimeter portions.

5. The guard of claim 1, comprising a plurality of said first openings formed in said distal surface, a plurality of said second openings formed in said proximal surface, and a plurality of said apertures formed by said plurality of first openings overlaying said plurality of second openings, respectively.

6. The guard of claim 5, wherein said plurality of first openings are provided in a plurality of rows and a plurality of columns.

7. The guard of claim 5, wherein said plurality of first openings and said plurality of second openings are provided in waffle patterns in said distal and proximal surfaces, respectively, and wherein said first openings are offset from said second openings to form said apertures.

8. The guard of claim 1, wherein a smallest cross-sectional dimension of said first opening is at least twice as great as a largest cross-sectional dimension of said aperture and a smallest cross-sectional dimension of said second opening is at least twice as great as said largest cross-sectional dimension of said aperture.

9. The guard of claim 1, further comprising a berm circumscribing said filter portion and extending toward a distal end of said guard.

10. The guard of claim 1, wherein said space access device comprises an in-the-ear hearing aid.

11. The guard of claim 1, wherein said space access device comprises an earpiece speaker.

12. The guard of claim 1, wherein said securing mechanism is attached to said space access device.

13. The guard of claim 1, wherein said securing mechanism further comprises a sound blocking portion disposed on at least a portion of said base, said sound blocking portion being configured to seal circumferentially around the surface of the internal space or opening.

14. The guard of claim 13, wherein said adjustable securing mechanism is configured to allow external sound to be transmitted therepast when said securing mechanism is secured in the internal space or opening and said sound blocking portion is configured to prevent external sound to be transmitted therepast when said securing mechanism is secured in the internal space or opening.

15. The guard of claim 13, wherein said sound blocking portion comprises a dome fixed to a distal end portion of said base.

16. The guard of claim 13, wherein said sound blocking portion comprises:

a second plurality of members, at least some of said members comprising at least one of: bristles, protrusions, ridges, grooves, blades, bubbles, hooks and tubes; and skirting, wherein said skirting is integrated in spaces between at least some of said second plurality of members.

17. The guard of claim 13, wherein said skirting is integrated with at least two rows of said second plurality of members, and locations along which said portions of said skirting overlap one another in one of said at least two rows are offset from locations along which said portions of said skirting overlap one another in another of said at least two rows.

18. The guard of claim 1, wherein said adjustable securing mechanism is configured to allow external sound to be transmitted therepast when said securing mechanism is secured in the internal space or opening.

19. A guard for a space access device configured to output air flow through a distal end portion thereof, said guard comprising:

a housing having a proximal end opening and a distal end opening, wherein said proximal end opening is configured to be placed nearer than said distal end opening to the output of air flow from the distal end portion of the space access device; and a filter portion positioned in said housing between said proximal and distal end openings, said filter portion comprising:

a distal surface, a proximal surface and a thickness, a first opening formed in said distal surface and extending into a first portion of said thickness; and a second opening formed in said proximal surface and extending into a second portion of said thickness;

wherein said first opening overlays said second opening to form an aperture that extends through said thickness;

wherein said first opening has a first cross-sectional area, said second opening has a second cross-sectional area and said aperture has a third cross-sectional area;

wherein said first cross-sectional area is greater than said third cross-sectional area and said second cross-sectional area is greater than said third cross-sectional area;

wherein a perimeter of said aperture is completely formed by a first perimeter portion formed by a portion of a perimeter of said first opening and a second perimeter portion formed by a portion of a perimeter of said second opening; and wherein said first and second perimeter portions are continuous portions.

20. The guard of claim 19, comprising a plurality of said first openings formed in said distal surface, a plurality of said second openings formed in said proximal surface, and a plurality of said apertures formed by said plurality of first openings overlaying said plurality of second openings, respectively.

21. The guard of claim 20, wherein said plurality of first openings are provided in a plurality of rows and a plurality of columns.

22. The guard of claim 20, wherein said plurality of first openings and said plurality of second openings are provided in waffle patterns in said distal and proximal surfaces, respectively, and wherein said first openings are offset from said second openings to form said apertures.

23. The guard of claim 19, wherein said first and second perimeter portions are on adjacent, parallel, but different planes, so that the said aperture is not formed by a tubular or other enclosed structure on any one plane parallel or coplanar with the parallel planes of said first and second perimeter portions.

24. The guard of claim 19, wherein a smallest cross-sectional dimension of said first opening is at least twice as great as a largest cross-sectional dimension of said aperture and a smallest cross-sectional dimension of said second opening is at least twice as great as said largest cross-sectional dimension of said aperture.

25. The guard of claim 19, further comprising a berm circumscribing said filter portion and extending toward a distal end of said guard.

26. The guard of claim 19, wherein said space access device comprises an in-the-ear hearing aid.

27. The guard of claim 19 attached to a securing mechanism, said securing mechanism comprising:

a base comprising a longitudinal axis and an outer surface; and an adjustable securing mechanism disposed on at least a portion of said base, said securing mechanism being configured to contact a surface of an internal space or opening into which said securing mechanism is inserted;

said adjustable securing mechanism being configured for positioning and maintaining said base at a distance from a location along the internal space or opening; and wherein a least a portion of said adjustable securing mechanism being configured to transition from a first state to a securing state when inserted into the internal space or opening, said securing state comprising at least a portion of said adjustable securing mechanism being constrained to have a smaller cross-sectional diameter relative to a cross-sectional diameter in said first state; and wherein said adjustable securing mechanism comprises a plurality of members configured to contact a wall of the internal space.

28. The guard of claim 27, wherein said securing mechanism further comprises a sound blocking portion disposed on at least a portion of said base, said sound blocking portion being configured to seal circumferentially around the surface of the internal space or opening.

29. The guard of claim 28, wherein said adjustable securing mechanism is configured to allow external sound to be transmitted therepast when said securing mechanism is secured in the internal space or opening and said sound blocking portion is configured to prevent external sound to be transmitted therepast when said securing mechanism is secured in the internal space or opening.

30. The guard of claim 28, wherein said sound blocking portion comprises a dome fixed to a distal end portion of said base.

31. The guard of claim 28, wherein said sound blocking portion comprises:

a second plurality of members, at least some of said members comprising at least one of: bristles, protrusions, ridges, grooves, blades, bubbles, hooks and tubes; and skirting, wherein said skirting is integrated in spaces between at least some of said second plurality of members.

32. The guard of claim 31, wherein said skirting is integrated with at least two rows of said second plurality of members, and locations along which said portions of said skirting overlap one another in one of said at least two rows are offset from locations along which said portions of said skirting overlap one another in another of said at least two rows.

33. The guard of claim 27, wherein said adjustable securing mechanism is configured to allow external sound to be transmitted therepast when said securing mechanism is secured in the internal space or opening.

34. A guard for a space access device configured to output air flow through a distal end portion thereof, said guard comprising:

a housing having a proximal end opening and a distal end opening, wherein said proximal end opening is configured to be placed nearer than said distal end opening to the output of air flow from the distal end portion of the space access device; and a filter portion positioned in said housing between said proximal and distal end openings, said filter portion comprising:

a distal surface, a proximal surface and a thickness, a first opening formed in said distal surface and extending into a first portion of said thickness; and a second opening formed in said proximal surface and extending into a second portion of said thickness, wherein said first opening ends wherein said first portion of said thickness meets said second portion of said thickness and said second opening ends where said second portion of said thickness meets said first portion of said thickness;

wherein said first opening overlays said second opening to form an aperture that extends through said thickness;

wherein said first opening has a first cross-sectional area, said second opening has a second cross-sectional area and said aperture has a third cross-sectional area; and wherein said first cross-sectional area is greater than said third cross-sectional area and said second cross-sectional area is greater than said third cross-sectional area.

35. The guard of claim 34, wherein a smallest cross-sectional dimension of said first opening is at least twice as great as a largest cross-sectional dimension of said aperture and a smallest cross-sectional dimension of said second opening is at least twice as great as said largest cross-sectional dimension of said aperture.

36. The guard of claim 34, wherein said guard comprises a plurality of said first openings formed in said distal surface, a plurality of said second openings formed in said proximal surface, and a plurality of said apertures formed by said plurality of first openings overlaying said plurality of second openings, respectively; and wherein said plurality of first openings are provided in a plurality of rows and a plurality of columns.

37. The guard of claim 34 attached to a securing mechanism, said securing mechanism comprising:

a base comprising a longitudinal axis and an outer surface; and an adjustable securing mechanism disposed on at least a portion of said base, said securing mechanism being configured to contact a surface of an internal space or opening into which said securing mechanism is inserted;

said adjustable securing mechanism being configured for positioning and maintaining said base at a distance from a location along the internal space or opening; and wherein a least a portion of said adjustable securing mechanism being configured to transition from a first state to a securing state when inserted into the internal space or opening, said securing state comprising at least a portion of said adjustable securing mechanism being constrained to have a smaller cross-sectional diameter relative to a cross-sectional diameter in said first state; and wherein said adjustable securing mechanism comprises a plurality of members configured to contact a wall of the internal space.

38. The guard of claim 34, wherein a perimeter of said aperture is formed by a first perimeter portion formed by a portion of a perimeter of said first opening and a second perimeter portion formed by a portion of a perimeter of said second opening; and wherein each of said first and second perimeter portions are continuous portions.

* * * * *